US008796591B2

(12) United States Patent
Schwartz

(10) Patent No.: US 8,796,591 B2
(45) Date of Patent: Aug. 5, 2014

(54) APPARATUS AND METHOD FOR WARMING A BABY BOTTLE

(76) Inventor: Eric D. Schwartz, Palm Beach Gardens, FL (US)

( * ) Notice: Subject to any disclaimer, the term of this patent is extended or adjusted under 35 U.S.C. 154(b) by 651 days.

(21) Appl. No.: 13/019,663

(22) Filed: Feb. 2, 2011

(65) Prior Publication Data

US 2012/0193347 A1 Aug. 2, 2012

(51) Int. Cl.
*H05B 1/02* (2006.01)

(52) U.S. Cl.
USPC ..... 219/482; 219/494; 219/430; 219/439; 126/263.01; 126/263.09

(58) Field of Classification Search
CPC ..... H05B 1/0269
USPC ..... 219/482, 494, 497, 492, 438, 439, 432, 219/430, 441; 126/263.01, 263.05, 263.08, 126/263.09
See application file for complete search history.

(56) References Cited

U.S. PATENT DOCUMENTS

| | | | | |
|---|---|---|---|---|
| 2,516,637 | A | 7/1950 | McCollum | |
| 2,526,447 | A | 10/1950 | Aiken | |
| 2,609,479 | A | 9/1952 | Loewe | |
| 4,573,447 | A * | 3/1986 | Thrash et al. | 44/251 |
| 5,042,455 | A * | 8/1991 | Yue et al. | 126/263.02 |
| 5,436,429 | A | 7/1995 | Cline | |
| 5,975,337 | A * | 11/1999 | Hadley | 220/592.17 |
| 6,469,280 | B2 | 10/2002 | Graham et al. | |
| 6,601,576 | B1 * | 8/2003 | Baysinger et al. | 126/263.06 |
| 6,921,880 | B2 * | 7/2005 | Berger | 219/386 |
| 2006/0081599 | A1 * | 4/2006 | Anderson | 219/438 |
| 2008/0178865 | A1 * | 7/2008 | Retterer | 126/263.08 |
| 2008/0251063 | A1 | 10/2008 | Palena et al. | |
| 2012/0061376 | A1 * | 3/2012 | McBean et al. | 219/430 |

OTHER PUBLICATIONS http://www.babyage.com/products/4225-pl_prince_lionheart_prince_lionheart_on_the_go_bottle_warmer.htm.
http://www.petersofkensington.com.au/Product/ProductInfo.aspx?id=1625368&cid=483.
http://www.babyage.com/products/4225-pl_prince_lionheart_prince_lionheart_on_the_go_bottle_warmer.htm, 2 pgs., Sep. 2009.
http://www.petersofkensington.com.au/Product/ProductInfo.aspx?id=1625368&cid=483, 1 pg., Sep. 2009.
http://www.mom4life.com/catalog.php?item=1255, 3 pgs., Sep. 2009.
http://www.babyage.com/dex_products/53171/dex_products_grab_n_go_bottle_warmer.htm, 1 pg., Sep. 2009.

* cited by examiner

*Primary Examiner* — Mark Paschall
(74) *Attorney, Agent, or Firm* — Akerman LLP; Roy P. Zachariah

(57) ABSTRACT

An apparatus for warming a container, the apparatus including a holder having an inner wall, an outer wall, and an insulation layer between the inner and outer walls, wherein the inner wall defines a first volume having a size and shape for receiving at least a portion of the container, and wherein the holder defines a second volume. The apparatus can also include a solution and an activation disk positioned within the second volume and in contact with the solution, wherein the solution and activation disk are made from materials such that a force applied to the activation disk causes the solution to undergo a chemical reaction that generates heat for warming the container in the first volume. Furthermore, the apparatus can include a disk actuator for applying the force to the activation disk, and elastic bands to increase thermal contact between the container and the solution.

21 Claims, 24 Drawing Sheets

100

506

200

300

500

600

700

900

1000

APPARATUS AND METHOD FOR WARMING A BABY BOTTLE

FIELD OF THE INVENTION

The present application relates to temperature regulating containers and apparatuses, and more particularly to an apparatus and method for warming a container, such as, but not limited to, baby bottles, glasses, cups, and other similar containers.

BACKGROUND

Generally speaking, many babies often desire food or drinks which are not served at extreme temperatures, but, instead, are served at warm temperatures. As a result, parents and/or others often have to utilize various different types of heating methods and apparatuses to ensure that babies' food or drinks are at the babies' preferred temperature range. Currently, there are a variety of different types of apparatuses and methods used for warming food and drinks for babies. For example, many people use heat or gel packs, which can often be microwaved, boiled, or otherwise heated and then applied to a container to warm the container. Additionally, people microwave or heat the actual bottles or other containers, use thermal sleeves for retaining heat inside bottles covered by the thermal sleeves, use electrical or battery sources for heating, or use containers such as thermoses, which are specifically designed to keep food or drinks at a warm temperature for extended periods of time.

Although these and a variety of other methods and apparatuses exist for warming bottles and other similar containers, such methods and apparatuses can often be inconvenient, ineffective, cumbersome, require the use of power sources, or even be unsafe, particularly for babies. For example, a heat pack which is boiled or microwaved can burn a baby's skin if the baby touches the heat pack and it is too hot. Also, some products do not effectively keep food or drinks warm long enough for a baby to enjoy. Furthermore, many other products can be easily tampered with, which can cause the product to lose its warming functionality or even cause injuries.

SUMMARY

In accordance with one aspect of the exemplary embodiments provided herein, an apparatus for warming a container may be provided. The apparatus may include a holder having an inner wall, an outer wall, and an insulation layer between the inner and outer walls, wherein the inner wall may define a first volume having a size and shape for receiving at least a portion of the container, and wherein the holder may define a second volume. Additionally, the apparatus may include a solution positioned within the second volume and an activation disk positioned within the second volume and in contact with the solution, wherein the solution and activation disk are made from materials such that a force applied to the activation disk causes the solution to undergo a chemical reaction that generates heat for warming the container in the first volume. Furthermore, the apparatus may include a disk actuator for applying the force to the activation disk and one or more elastic bands in the second volume that are adapted to increase thermal contact between the container and the solution.

In accordance with another exemplary embodiment, a method for warming a container, which can include, but is not limited to including, the steps of: inserting a container in a holder that defines first and second volumes, wherein the first volume has a size and shape for receiving at least a portion of the container, wherein the second volume is in proximity to the first volume, and wherein an activation disk and a solution are contained in the second volume; applying a force to the activation disk to cause the solution to undergo a chemical reaction that generates heat for warming the container in the first volume; and increasing the thermal contact between the solution and the container using one or more elastic bands in the second volume.

In accordance with another exemplary embodiment, an apparatus for warming a container is provided. The apparatus may include a holder defining first and second volumes and including a removable bottom portion, wherein the second volume may be concentrically aligned with the first volume, and wherein the first volume has a size and shape to receive at least a portion of the container. Also, the apparatus may include a fastening mechanism for attaching the removable bottom portion to the holder. The apparatus may additionally include an insulation portion which may surround the first and second volumes. Furthermore, the apparatus may include one or more elastic bands and a conductive material, which may reside in between the first and second volumes. Notably, a solution may be positionable in the second volume, wherein an activation disk may be positionable within the second volume to be in contact with the solution. The activation disk and the solution may be made from materials whereby application of a force to the activation disk causes the solution to undergo a chemical reaction and thereby generate heat, and wherein the elastic band increases the thermal contact between the solution and the container.

In accordance with yet another exemplary embodiment, another apparatus for warming a container can be provided. The apparatus may include a holder having an inner wall, an outer wall, and an insulation layer between the inner and outer walls, wherein the inner wall may define a first volume having a size and shape for receiving at least a portion of the container, and wherein the holder defines a second volume. Additionally, the apparatus may include one or more elastic bands in the second volume that may be adapted to increase thermal contact between the warming apparatus and the container. Furthermore, the apparatus may include a heating source for generating heat for warming the container. The heating source may include one or more wires that can be positioned in the warming apparatus.

In accordance with still another exemplary embodiment, another apparatus for warming may be provided. The apparatus may include a holder, which may define first and second volumes. The first volume can have a size and shape for receiving at least a portion of an object via at least one of a top and a bottom portion of the holder. Notably, the top and bottom portions may be at least partially open. The apparatus may also include a solution within the second volume. Additionally, the apparatus may include an activation disk positioned within the second volume and in contact with the solution. The solution and activation disk may be made from materials such that a force applied to the activation disk causes the solution to undergo a chemical reaction that generates heat for warming the container in the first volume. The apparatus may further include a disk actuator for applying the force to the activation disk. Moreover, the apparatus may include one or more elastic bands in the second volume that are adapted to increase thermal contact between the container and the solution.

The above-described and other features and advantages of the present disclosure will be appreciated and understood by those skilled in the art from the following detailed description, drawings, and appended claims.

DETAILED DESCRIPTION OF THE INVENTION

Figure 1A:
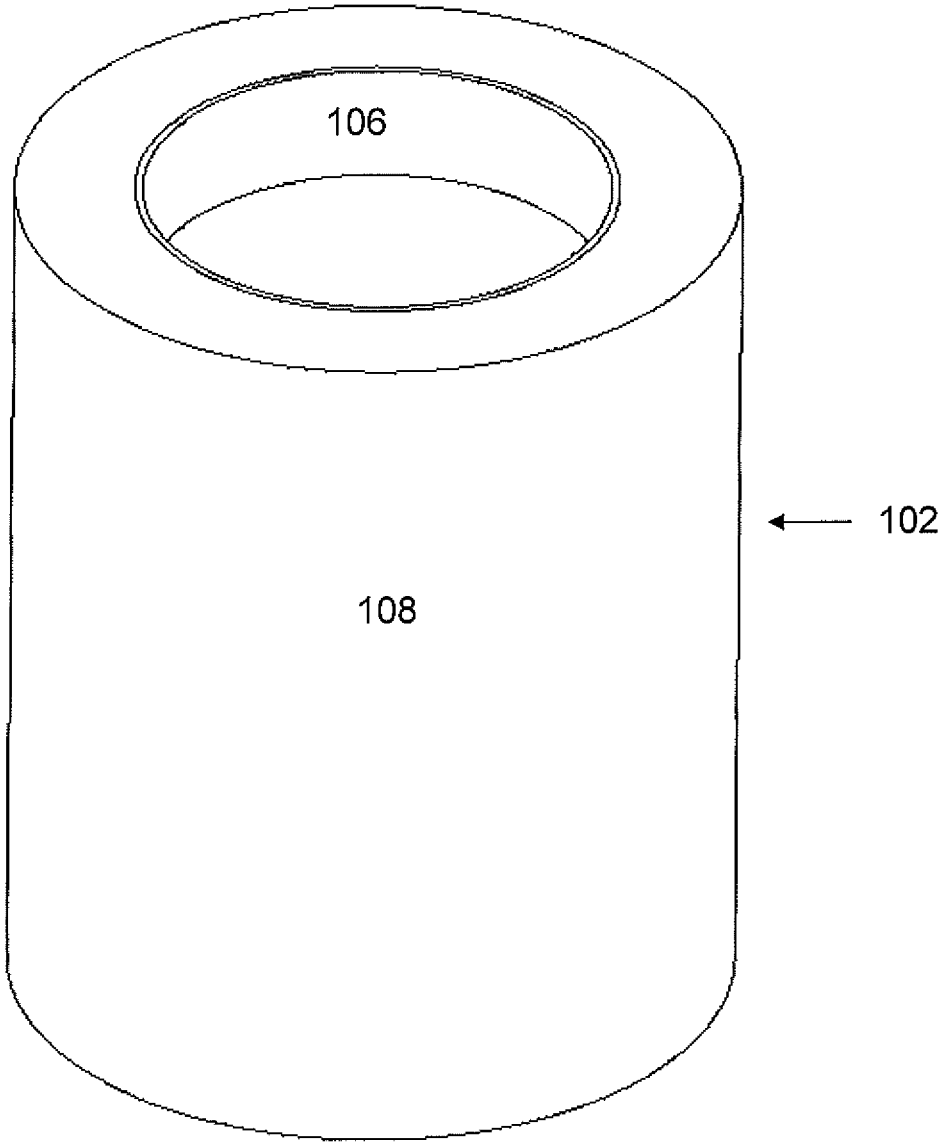
FIG. 1A illustrates a front view of a bottle warming apparatus according to an exemplary embodiment according the invention.
Figure 1B:
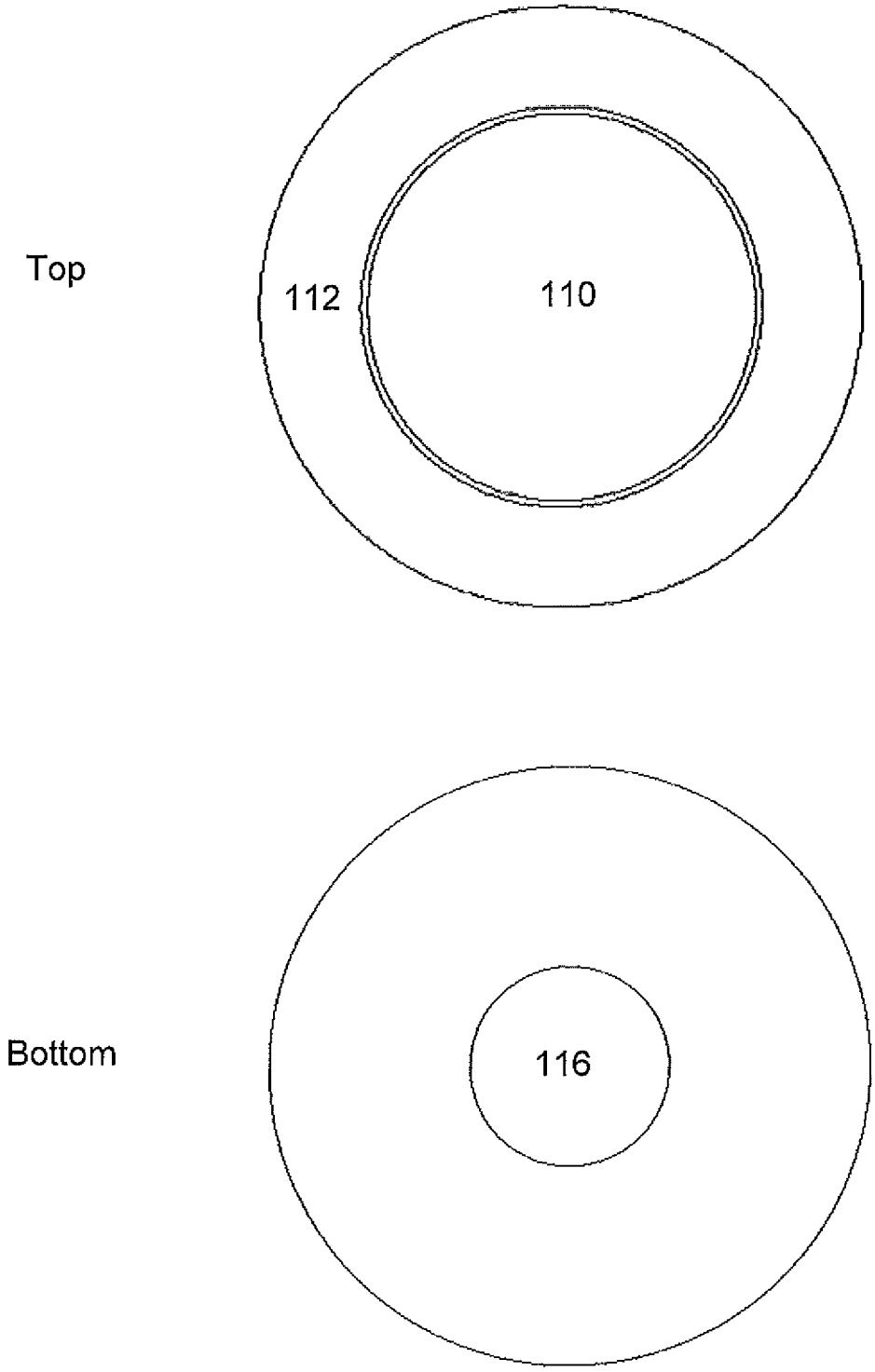
FIG. 1B illustrates top and bottom views of the bottle warming apparatus of FIG. 1A.
Figure 1C:
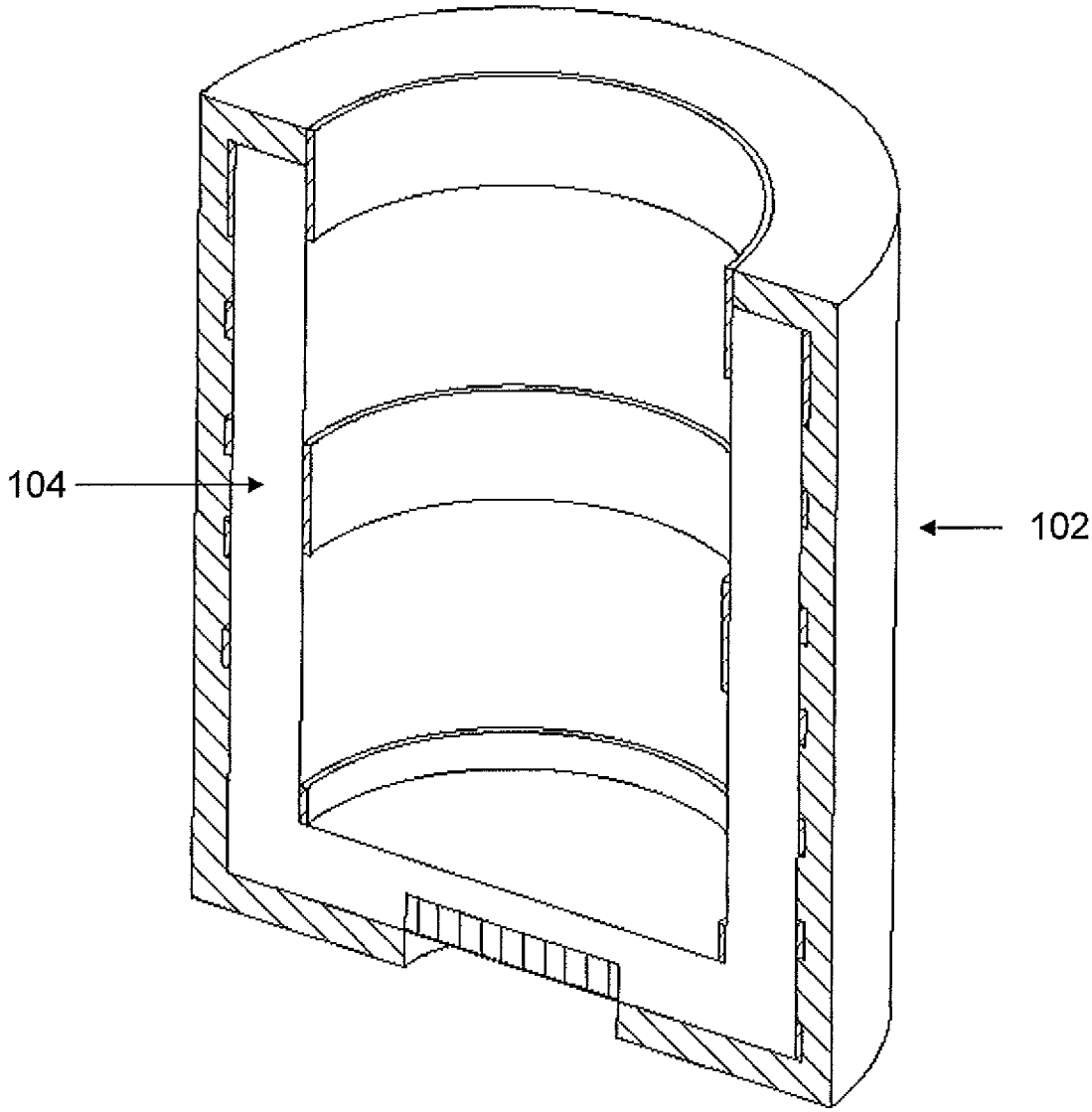
FIG. 1C illustrates a cross-sectional view of the bottle warming apparatus.
Figure 1D:
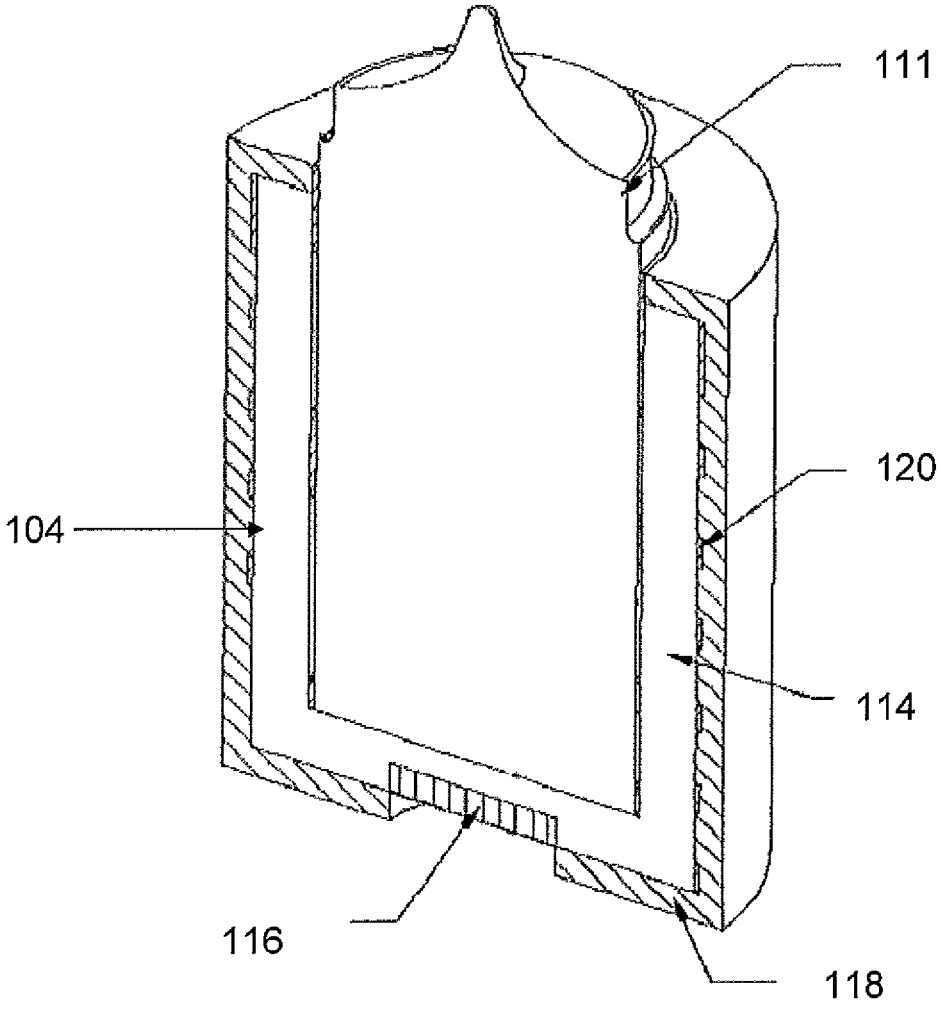
FIG. 1D illustrates a cross-sectional view of a baby bottle positioned into the bottle warming apparatus.
Figure 1E:
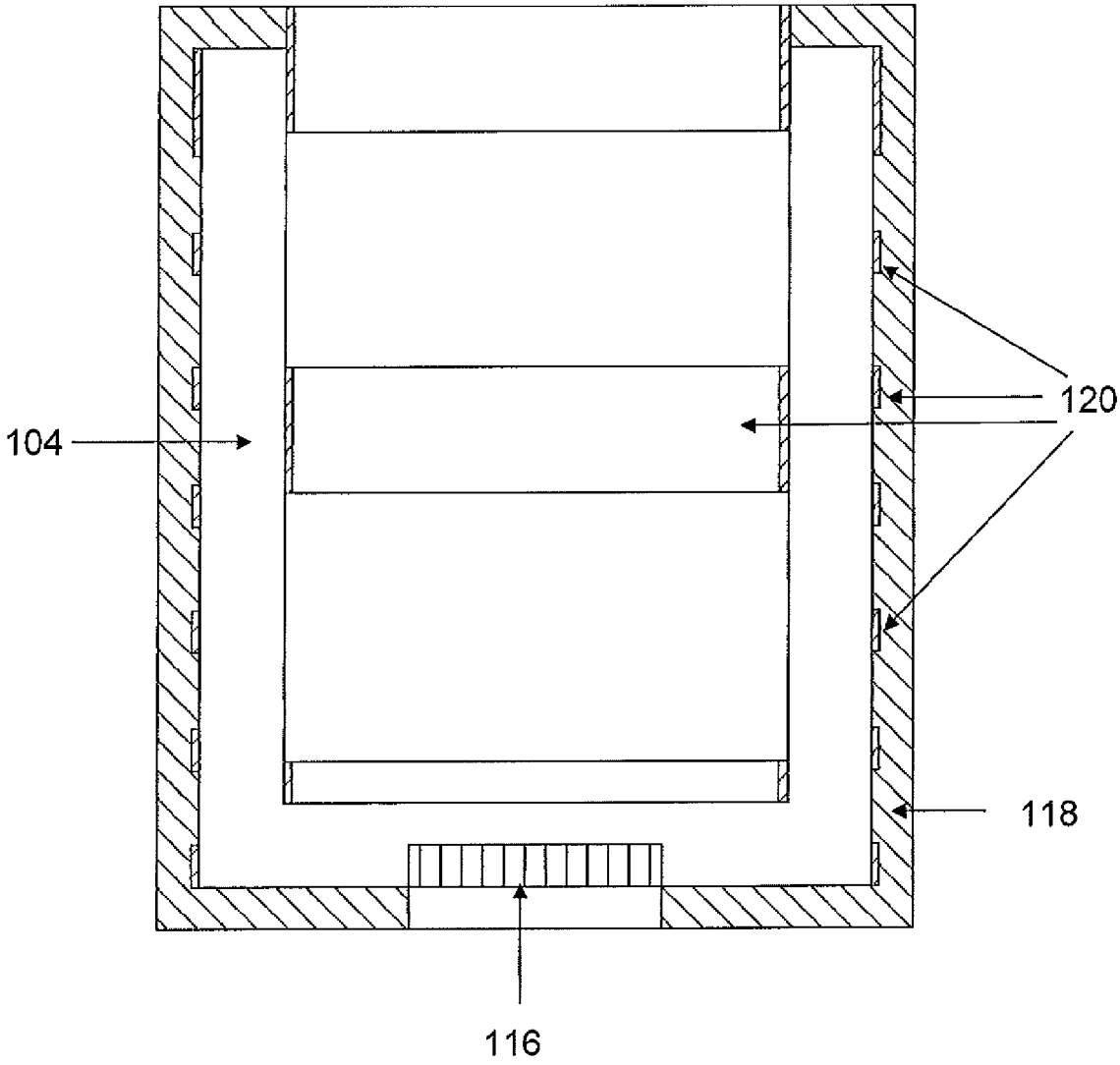
FIG. 1E illustrates a front cross-sectional view of the bottle warming apparatus.
Figure 1F:
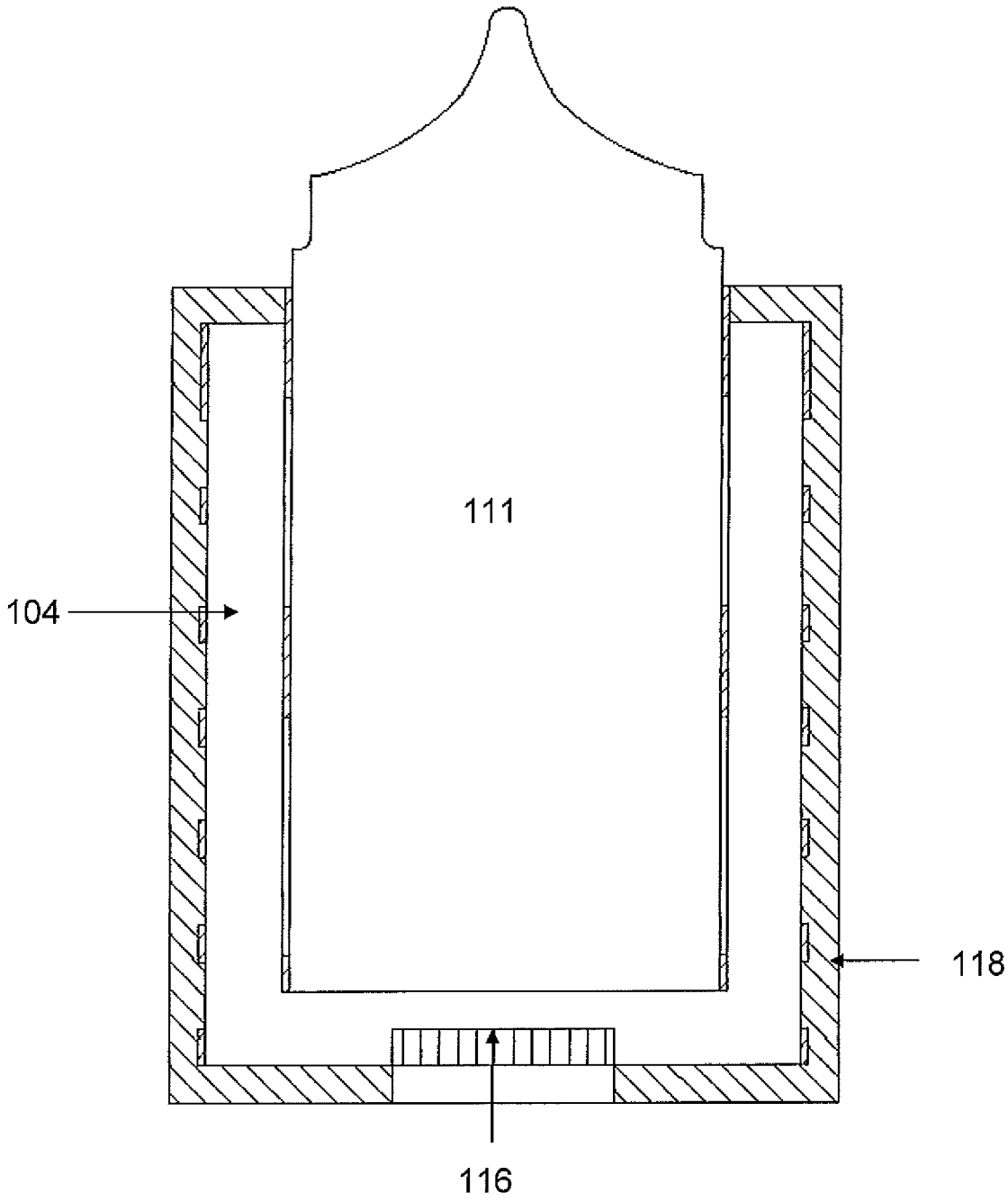
FIG. 1F illustrates a front cross-sectional view of a bottle in the bottle warming apparatus of FIG. 1E.

The exemplary embodiments of the present disclosure are described with respect to apparatuses and methods for warming a container. An apparatus for warming a container may include a holder having inner and outer walls and an insulation layer positioned between the inner and outer walls. In an embodiment, the inner wall may define a first volume having a size and shape for receiving at least a portion of the container and the holder may also define a second volume. The apparatus may include a solution that may be positioned within the second volume and an activation disk that may also be positioned within the second volume and may be in contact with the solution. The solution and the activation disk may be made from materials such that when a force is applied to the activation disk it causes the solution to undergo a chemical reaction that generates heat for warming the container in the first volume. Also, the apparatus may include a disk actuator for applying the force to the activation disk and one or more elastic bands in the second volume that are adapted to increase thermal contact between the container and the solution. It should be understood by one of ordinary skill in the art that the exemplary embodiments of the present disclosure can be applied to other types of warming apparatuses and methods, such as those described below. Additionally, features of the exemplary embodiments can be used with each other and/or with alternative features that are not shown.

Referring to the drawings and in particular to FIGS. 1A-1F, an exemplary embodiment of a bottle warmer 100 is illustrated. In FIGS. 1A-1F, the bottle warmer 100 is illustratively shown to have a particular structure, however, other alternative structures, such as those described below or otherwise, may also be utilized. The bottle warmer 100 may include a holder 102 and a bottle warming apparatus 104. The holder 102 may be configured to include an inner wall 106 and an outer wall 108. The inner wall 106 may define a first volume 110, which may be configured to have a size and shape for receiving various types of containers. For example, the first volume 110 may be configured to receive and hold a baby bottle 111 and/or other types of bottles in position. The inner wall 106 may also be configured to be flexible and have an annular shape. Additionally, the inner wall 106 may be lined with a conductor 107 so as to maximize heat transfer between the warming apparatus 104 and the baby bottle 111. In an embodiment, the conductor 107 may be made of aluminum metal and/or plastic that is configured to be expandable and/or fordable to allow for various types of bottles 111 to be placed in the first volume 110. The holder 102 may also be configured to include a second volume 112, which may lie between the inner wall 106 and the outer wall 108. In an embodiment, the second volume 112 may be concentrically aligned with the first volume 110. Notably, the bottle warming apparatus 104 may be configured to slide into or otherwise fit into the second volume 112.

The bottle warming apparatus 104 may be made of plastic or other suitable materials and may be configured to assume the shape of the second volume 112 of the bottle warmer 100. The bottle warming apparatus 104 may include a solution 114, such as a sodium acetate solution or other similar solution, which may be triggered into undergoing a chemical reaction that gives off heat. Additionally, the bottle warming apparatus 104 may include an activation disk 116. The activation disk 116 may correlate to the activator utilized in U.S. Pat. No. 4,872,442 or another other similar activation disk. In an embodiment, the activation disk 116 may comprise at least one of stainless steel, Berylium-copper alloy, and/or phosphor-bronze alloy and may be stitched into or otherwise affixed to the warming apparatus 104. When a user either directly applies a force to the activation disk 116 or utilizes a disk actuator to apply a force to the activation disk 116, the activation disk 116 may cause the solution 114, such as a sodium acetate solution, to undergo a chemical reaction that generates heat for warming the baby bottle 111 in the first volume 110. In the case of sodium acetate solution, the chemical reaction may comprise crystallization of the solution.

As the chemical reaction is taking place, the heat generated by the reaction may be utilized to warm the baby bottle 111 along with any contents inside the baby bottle 111. For example, milk, water, juices, purees, or other any contents may be heated so as to provide a baby or other individual with warm food. In order to keep the heat retained within the bottle warmer 100 for as long as possible, the bottle warmer 100 may include an insulation layer 118, which may reside between the warming apparatus 104 and the outer wall 108. In an embodiment, an outside portion of the insulation layer 118 may comprise the outer wall 108. The insulation layer 118 itself may be comprised of foam rubber or any other suitable insulator, which may be utilized to keep the heat generated by the chemical reaction retained within the bottle warmer 100 for as long as possible. Additionally, the insulation layer 118 may be utilized to prevent a user from burning their hands when grasping the bottle warmer 100. In another embodiment, a cover may be used to surround the insulation layer 118, in which case an outside portion of the cover may comprise the outer wall 108.

In addition to utilizing an insulation layer 118 to retain heat within the bottle warmer 100, the bottle warmer 100 may also include one or more elastic bands 120. The elastic bands 120 may be positioned along the outside of the warming apparatus 104, within the first volume 110, outside of the insulation layer 118, and/or at other locations in the bottle warmer 100. The elastic bands 120 may snugly fit around the warming apparatus 104 so as to reduce air gaps between the baby bottle 111 and the warming apparatus 104. By reducing the air gaps between the baby bottle 111 and the warming apparatus 104, a maximum amount of surface area of the warming apparatus 104 may be in contact with the baby bottle 111. Additionally, the elastic bands 120 may be utilized to increase the contact pressure between the warming apparatus 104 and the baby bottle 111. Increasing the contact pressure may increase the conductance between the surface of the baby bottle 111 and the warming apparatus 104. In effect, this may allow the heat to transfer from the warming apparatus 104 to the baby bottle 111 more efficiently.

Eventually the chemical reaction that the solution 114 is undergoing will slow down, thereby causing less and less heat to be generated by the warming apparatus 104. In an embodiment, the duration of the chemical reaction may be approximately ten to fifteen minutes, which may provide enough heat during consumption of any food contained in the baby bottle 111. After the chemical reaction has stopped and in order to reuse the warming apparatus 104, the entire bottle warmer 100 may be placed into boiling water for a period of time so as to deactivate the solution 114. Once deactivated, the user may then reapply a force to the activation disk 116 to reinitiate the chemical reaction to heat the baby bottle 111 again. This process may be repeated again and again as deemed necessary by the user.

Figure 2:
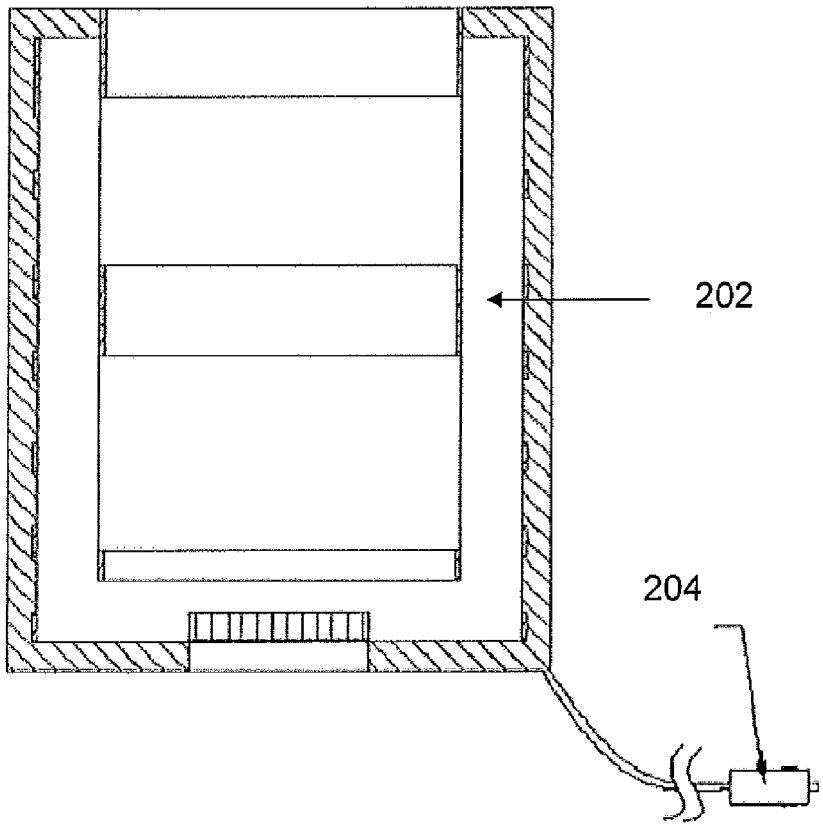
FIG. 2 illustrates a front cross-sectional view of a bottle warming apparatus featuring a mobile charger.
Figure 3:
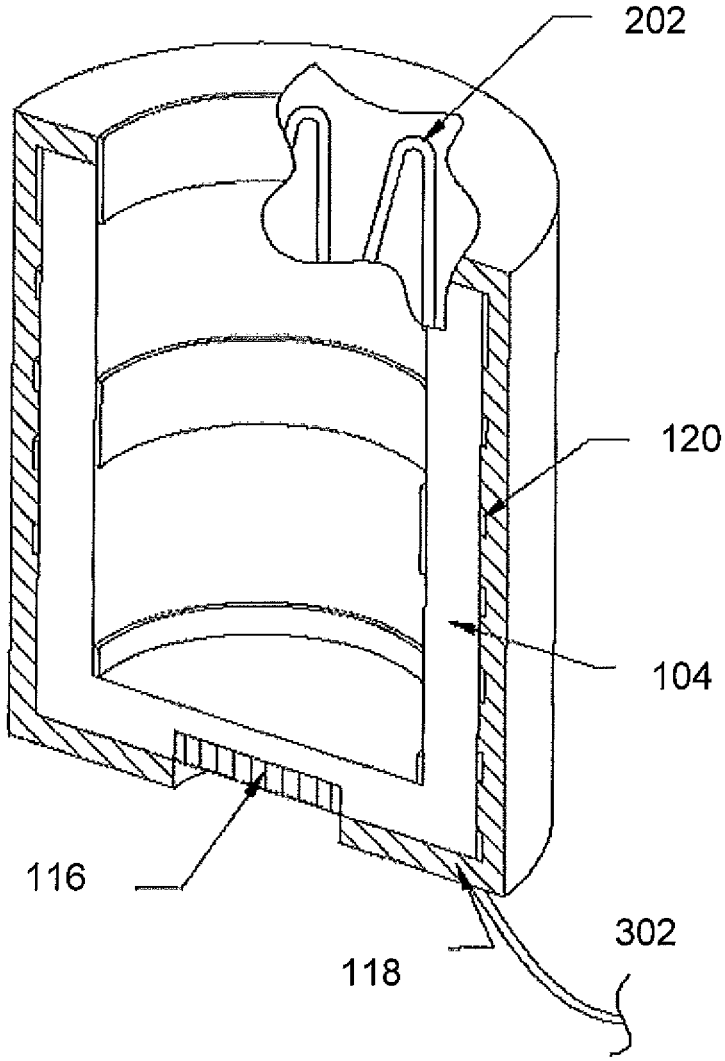
FIG. 3 illustrates a cross-sectional view of a bottle warming apparatus featuring electric heater wires for providing heat.
Figure 4:
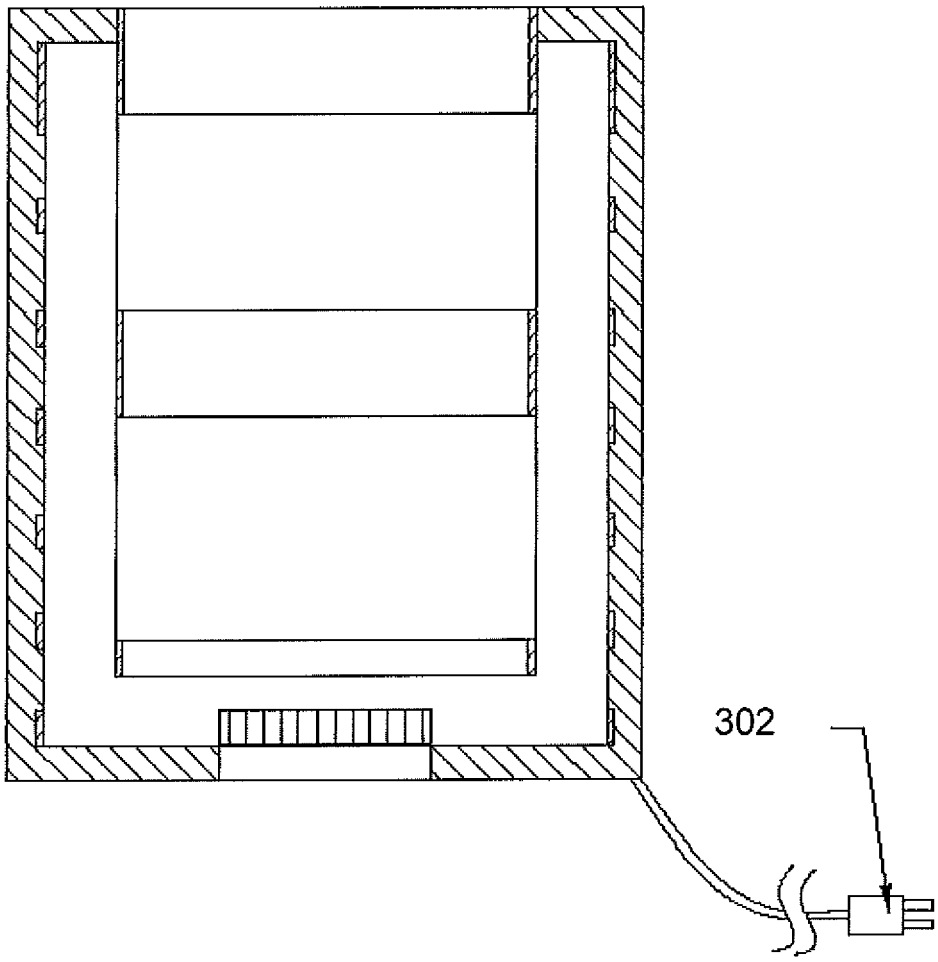
FIG. 4 illustrates a front cross-sectional view of a bottle warming apparatus featuring a wall charger.

In an embodiment and referring additionally to FIG. 2, another bottle warmer 200 may be provided. Instead of utilizing a solution which undergoes a chemical reaction to generate heat, the bottle warmer 200 may be fitted with electric heating wires or coils 202. The heating wires or coils 202 may be similar to those found in toaster ovens or other similar devices utilized to heat food. In an embodiment, the heating wires or coils 202 may be shielded from the outer wall 108 and the inner wall 106 by various protective means. In another embodiment, the bottle warmer 200 may include a mobile AC adapter 204, which may be utilized to charge the wires or coils 202 while the user is in a vehicle. For example, the mobile AC adapter 204 may be plugged into a vehicle's cigarette lighter or other similar interface so as to charge the coils 202. In another embodiment and referring additionally to FIGS. 3 and 4, yet another bottle warmer 300 may be provided. Bottle warmer 300 may be much like bottle warmer 200, however, bottle warmer 300 may be fitted with an electrical adaptor 302 that may be plugged in to a house or wall unit instead of into a vehicle.

Figure 5A:
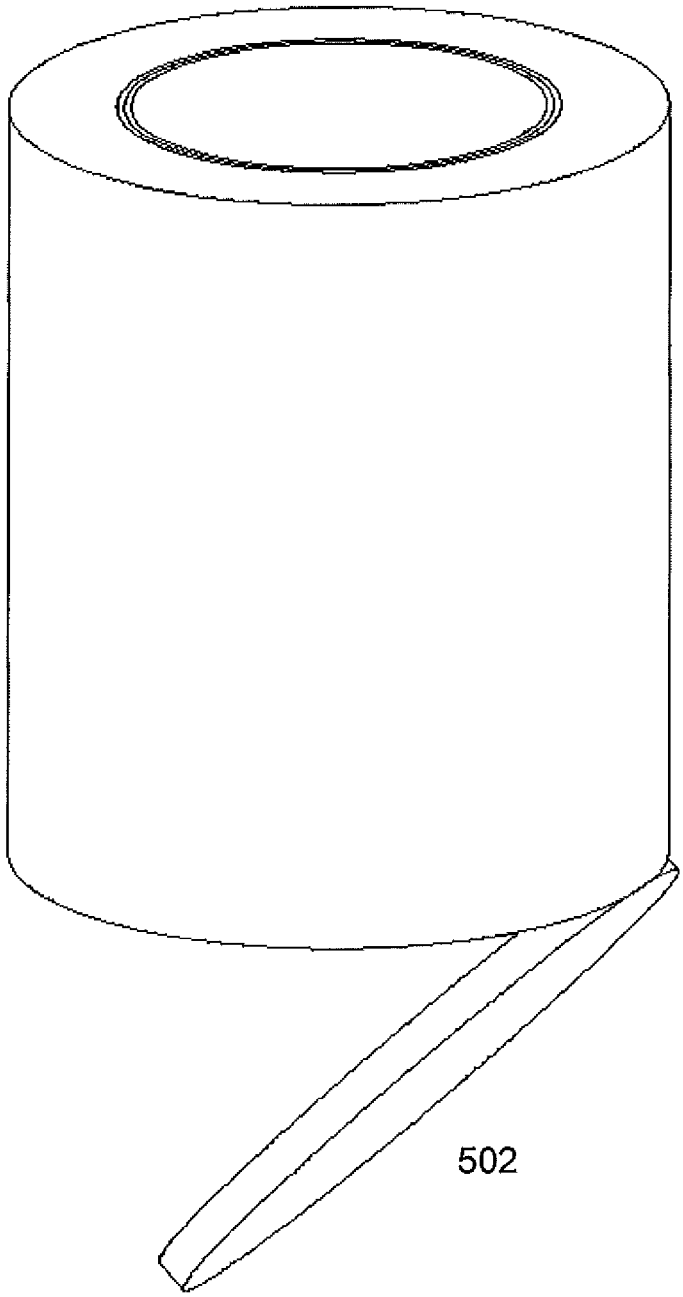
FIG. 5A illustrates a front view of a bottle warming apparatus featuring a partially removable bottom portion according to one embodiment of the invention.
Figure 5B:
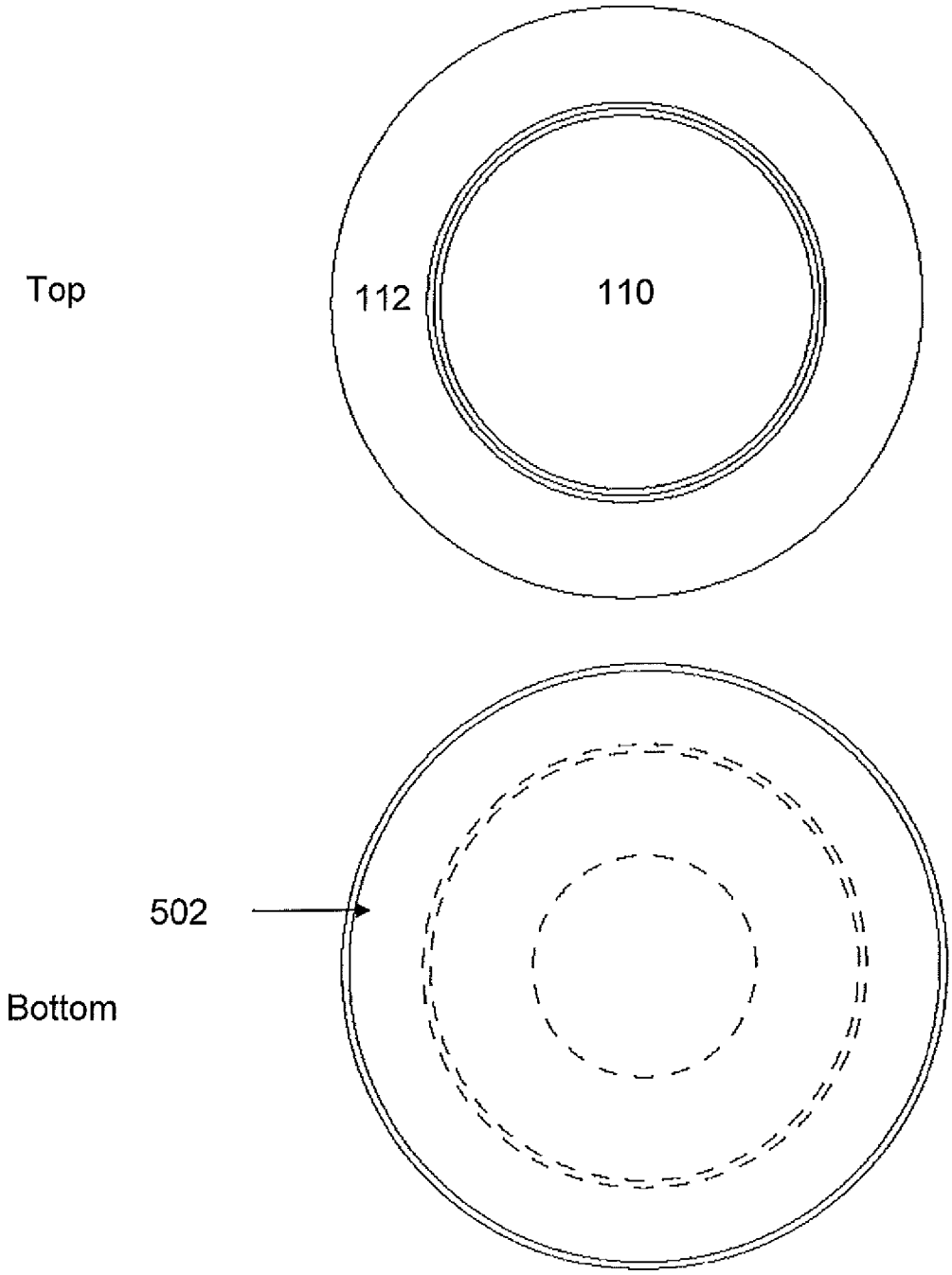
FIG. 5B illustrates top and bottom views of the bottle warming apparatus featuring the partially removable bottom portion.
Figure 5C:
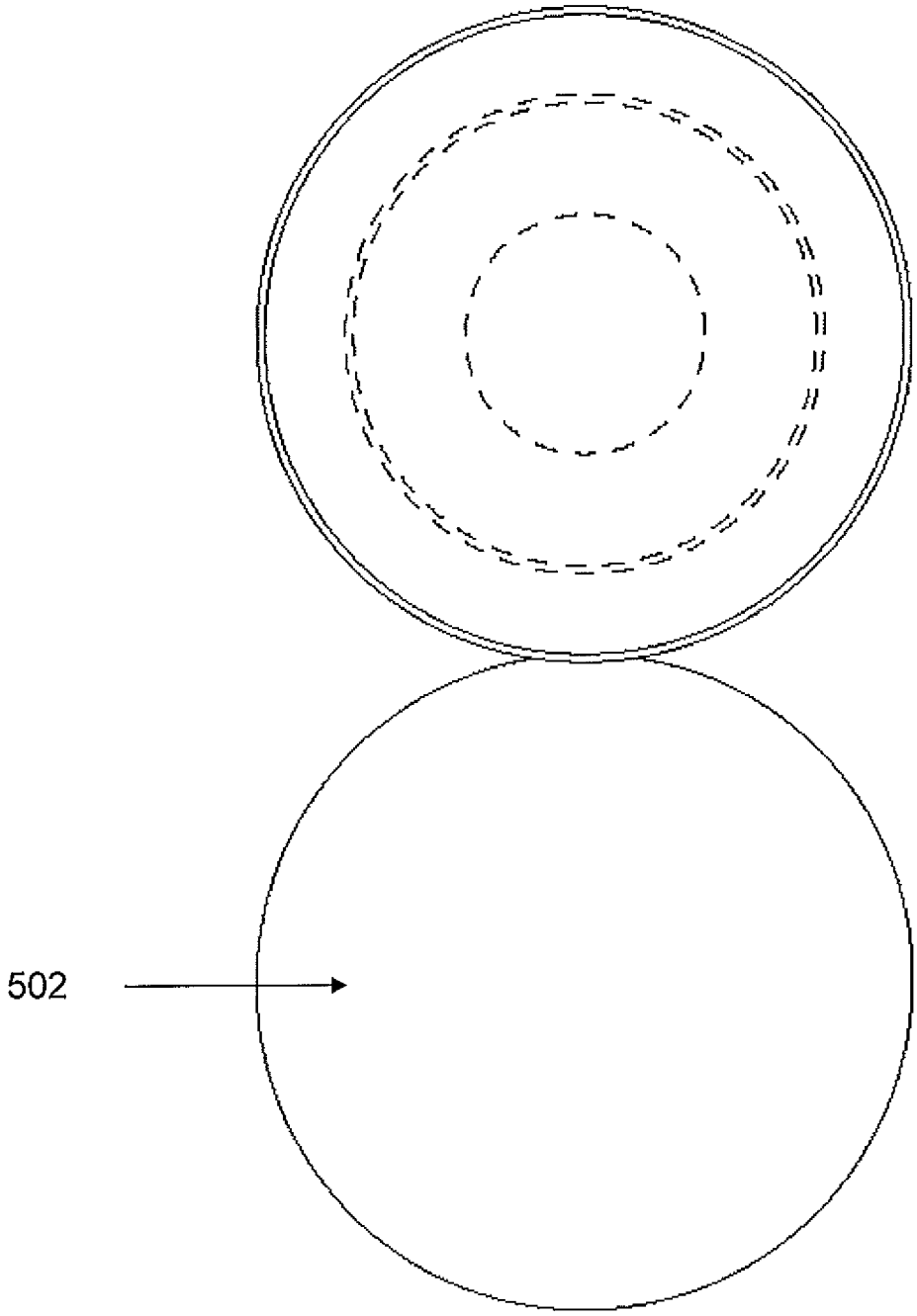
FIG. 5C illustrates a bottom view of the bottle warming apparatus featuring the removable bottom portion in an open position.
Figure 5D:
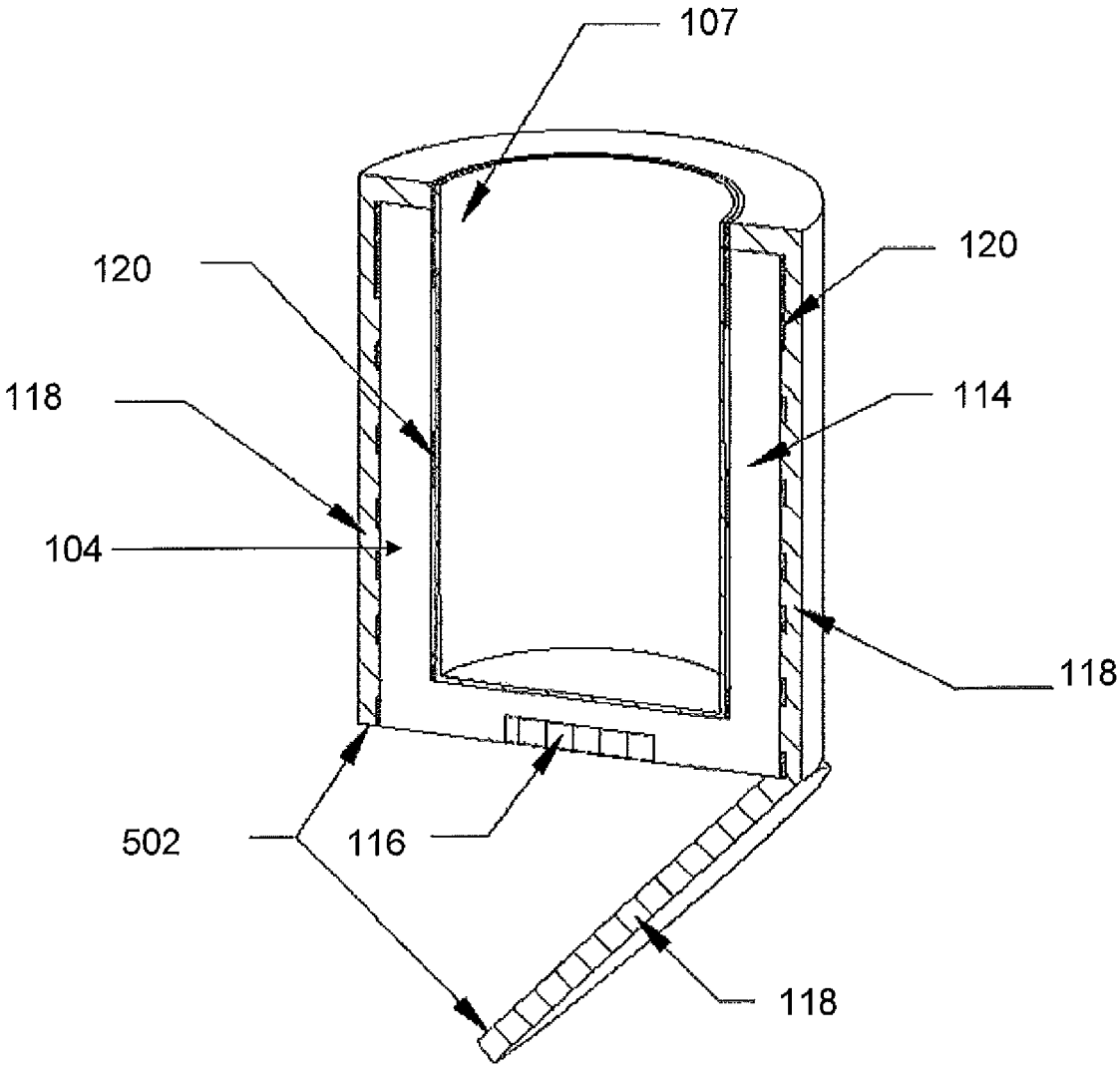
FIG. 5D illustrates a cross-sectional view of the bottle warming apparatus with the partially removable bottom portion.
Figure 5E:
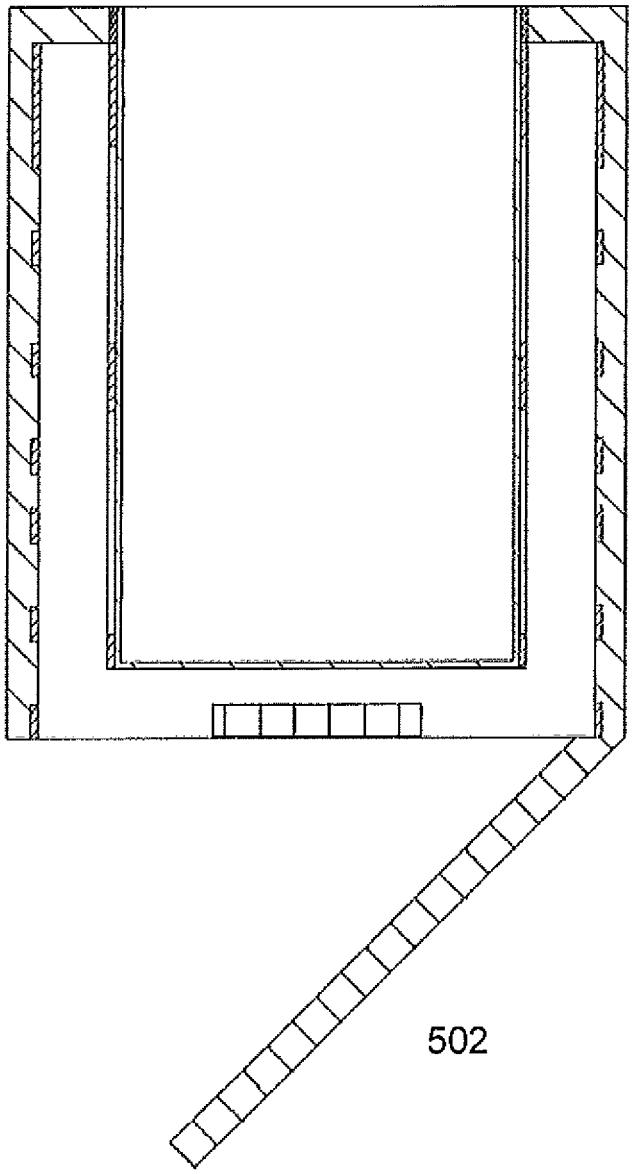
FIG. 5E illustrates a front cross-sectional view of the bottle warming apparatus with the partially removable bottom portion.
Figure 5F:
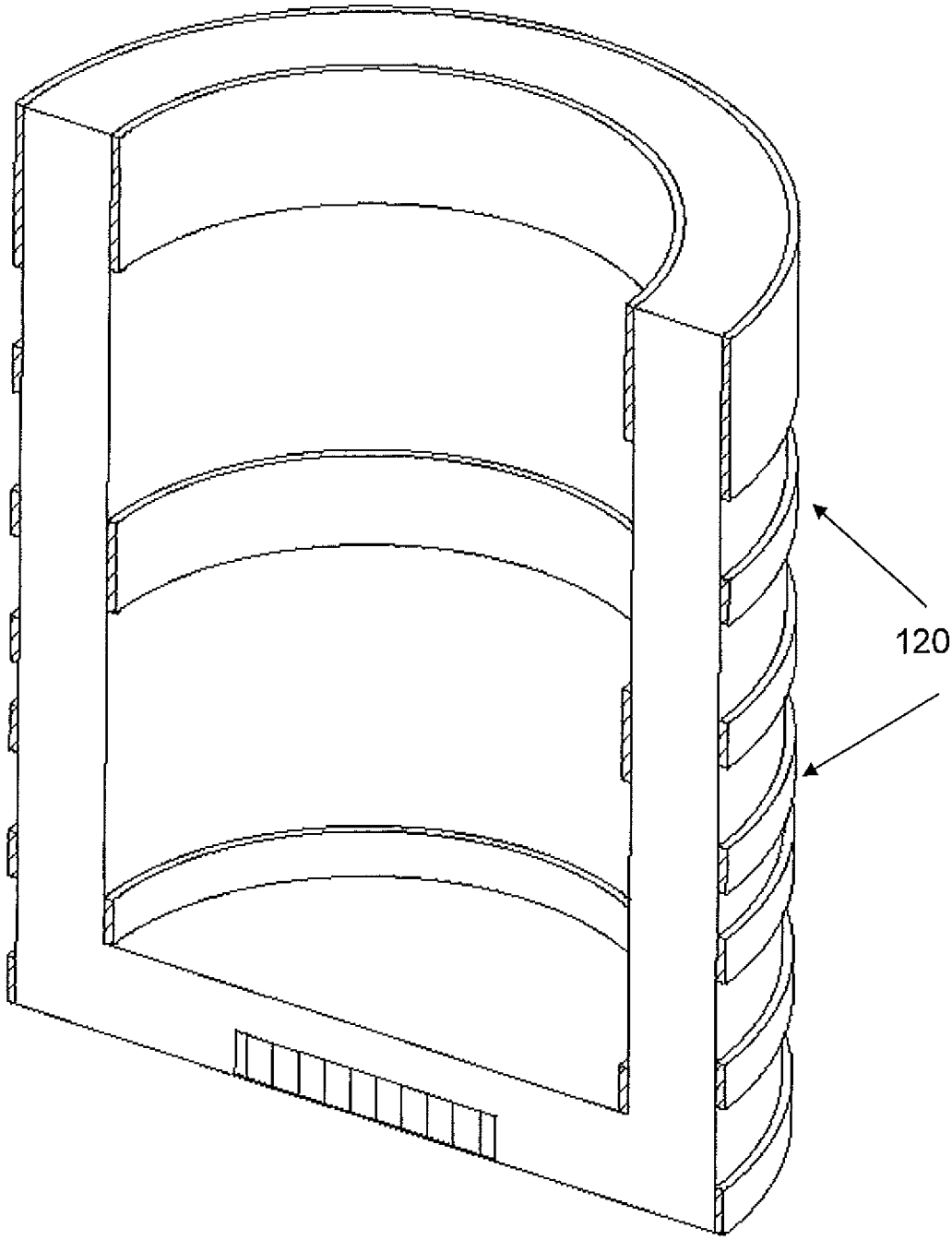
FIG. 5F depicts a cross-sectional view of the heater portion of the bottle warming apparatus.
Figure 5G:
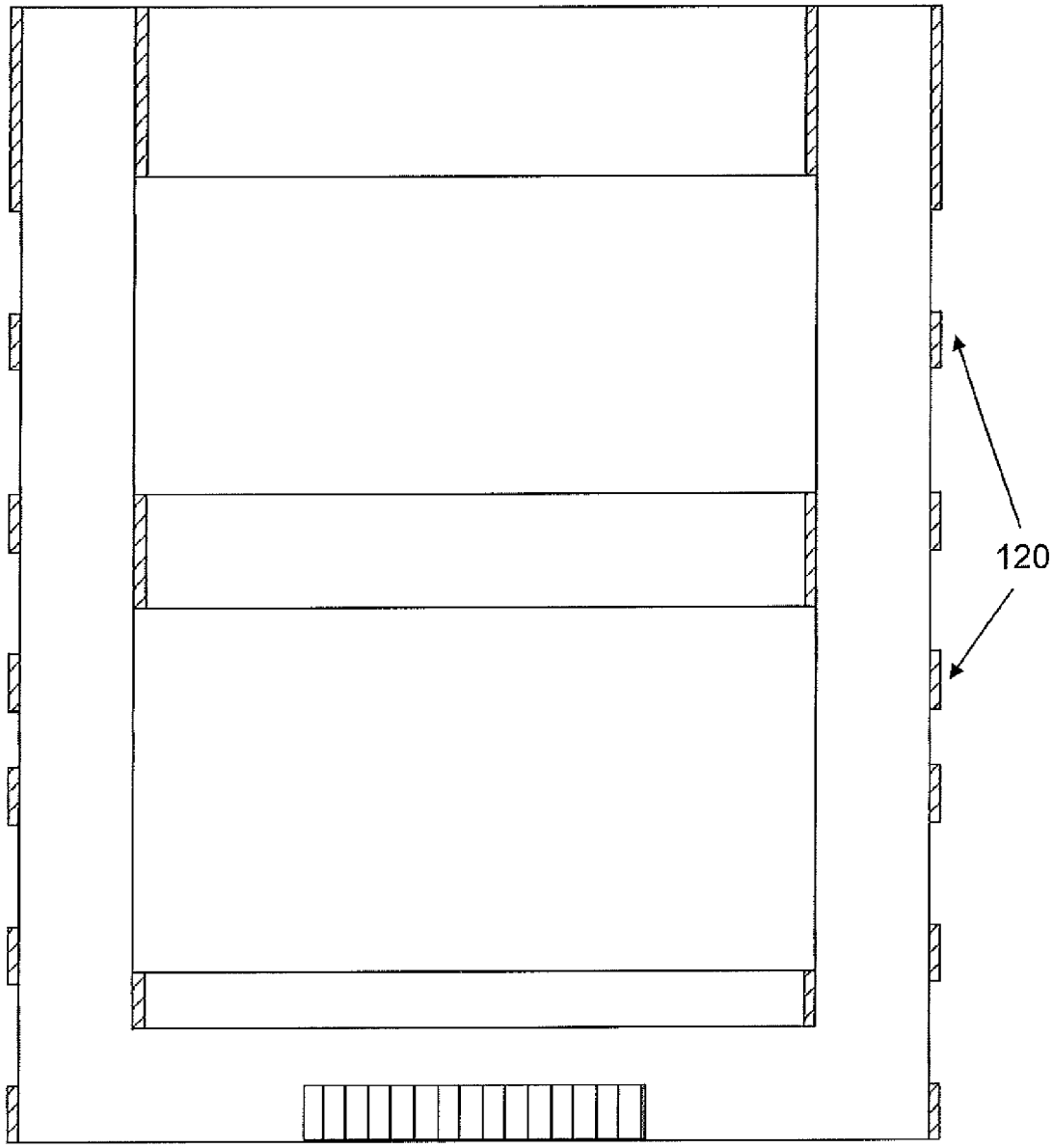
FIG. 5G depicts a front cross-sectional view of the heater portion of the bottle warming apparatus.
Figure 5H:
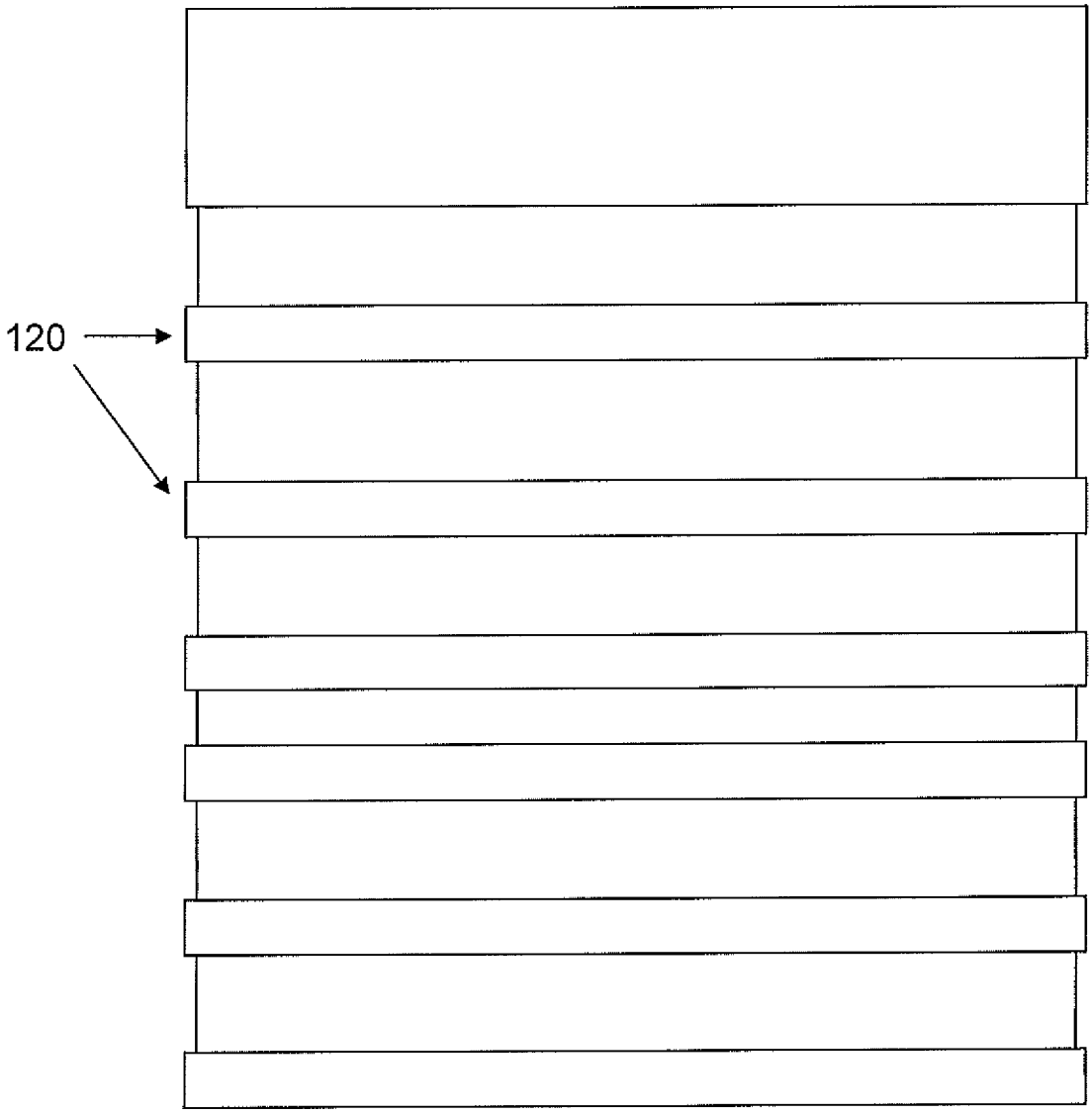
FIG. 5H depicts a front outside view of the heater portion of the bottle warming apparatus.
Figure 5I:
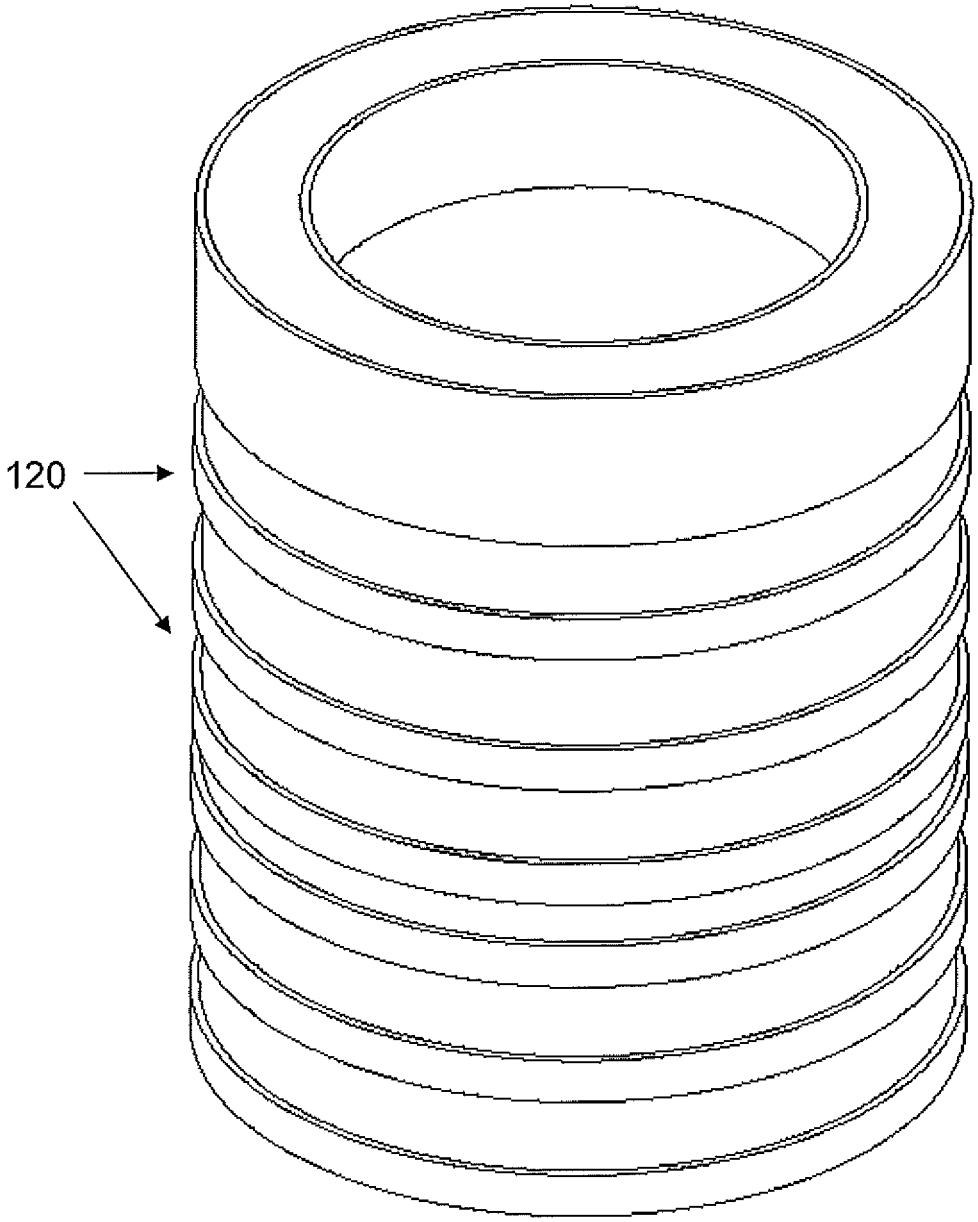
FIG. 5I depicts another front outside view of the heater portion of the bottle warming apparatus.
Figure 5J:
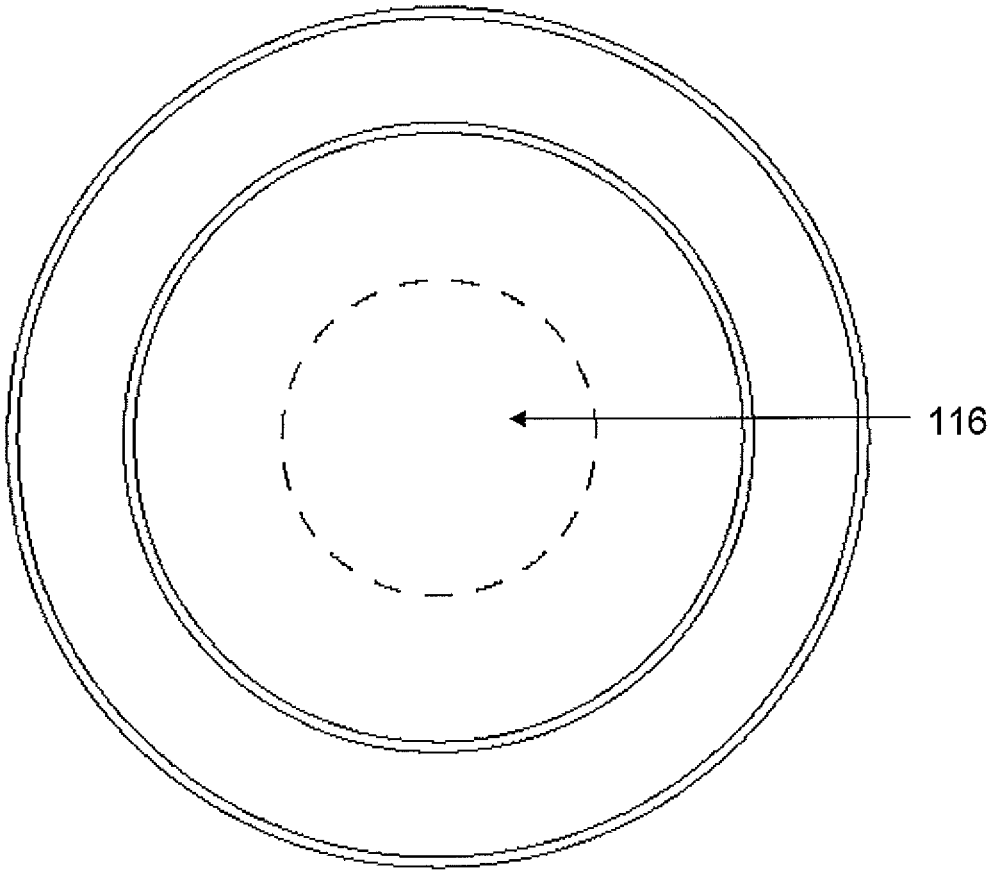
FIG. 5J illustrates a bottom view of the heater portion.

In another embodiment and referring additionally to FIGS. 5A-5J, another bottle warmer 500 may be provided. FIGS. 5H-5J illustrate the warming apparatus 104 removed from the bottle warmer 500. Bottle warmer 500 may be much like bottle warmer 100, except that bottle warmer 500 may include a removable or at least partially removable bottom portion 502. In an embodiment, a portion of the bottom portion 502 may be permanently attached to the base of the bottle warmer 500. The remaining portion of the bottom portion 502 may be configured to be detachable from the base of the bottle warmer 500. This other portion of the bottom portion 502 may be fastened to or detached from the base of the bottle warmer 500 by utilizing one or more of a zipper mechanism, a button mechanism, a hook and eye mechanism, a glue mechanism, Velcro, and a clip mechanism. In an embodiment, at least twenty-five percent of the bottom portion 502 is permanently attached to the base of the bottle warmer 500. In another embodiment, the bottom portion 502 may be configured to be completely detachable from the base of the bottle warmer 500. After using bottle warmer 500, a user may remove the warming apparatus 104 from the bottle warmer 500 after detaching or partially detaching the bottom portion 502. The user may then place only the warming apparatus 104 into boiling water to deactivate the solution 114. Once the warming apparatus 104 is deactivated, the user may reinsert the warming apparatus 104 into the base of the bottle warmer 500 and reattach the bottom portion 502.

Figure 6:
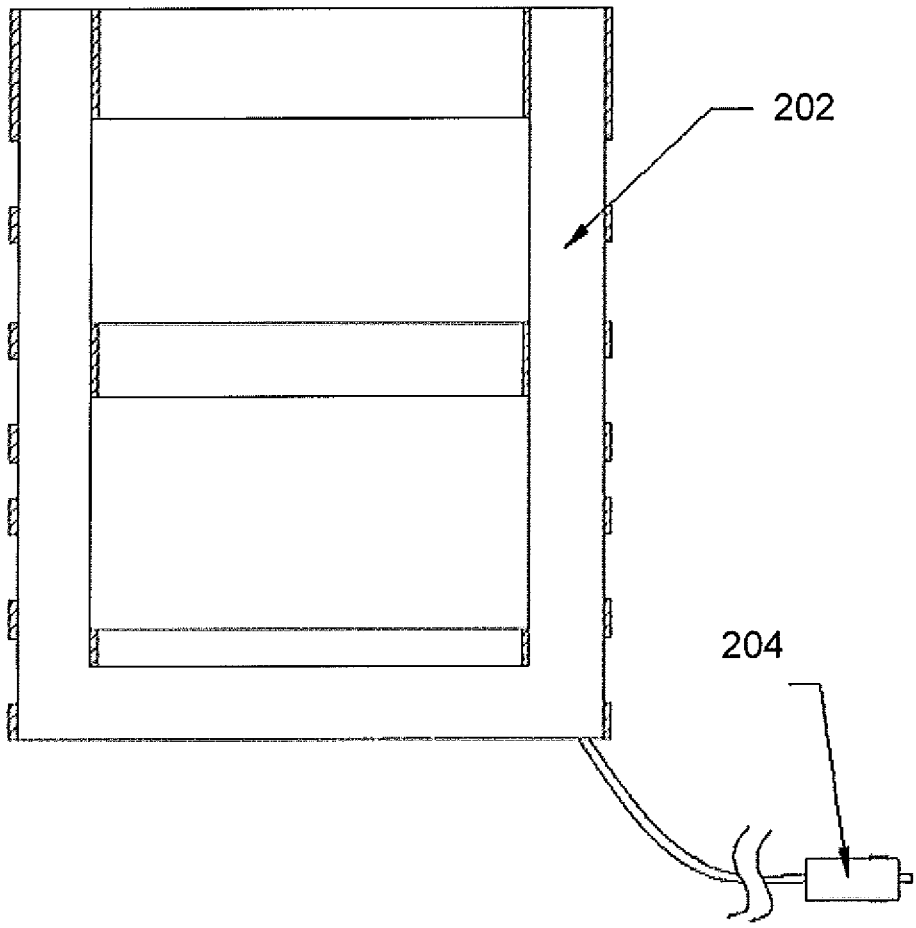
FIG. 6 illustrates a front cross-sectional view of a bottle warming apparatus featuring a partially removable bottom portion and a mobile charger.
Figure 7:
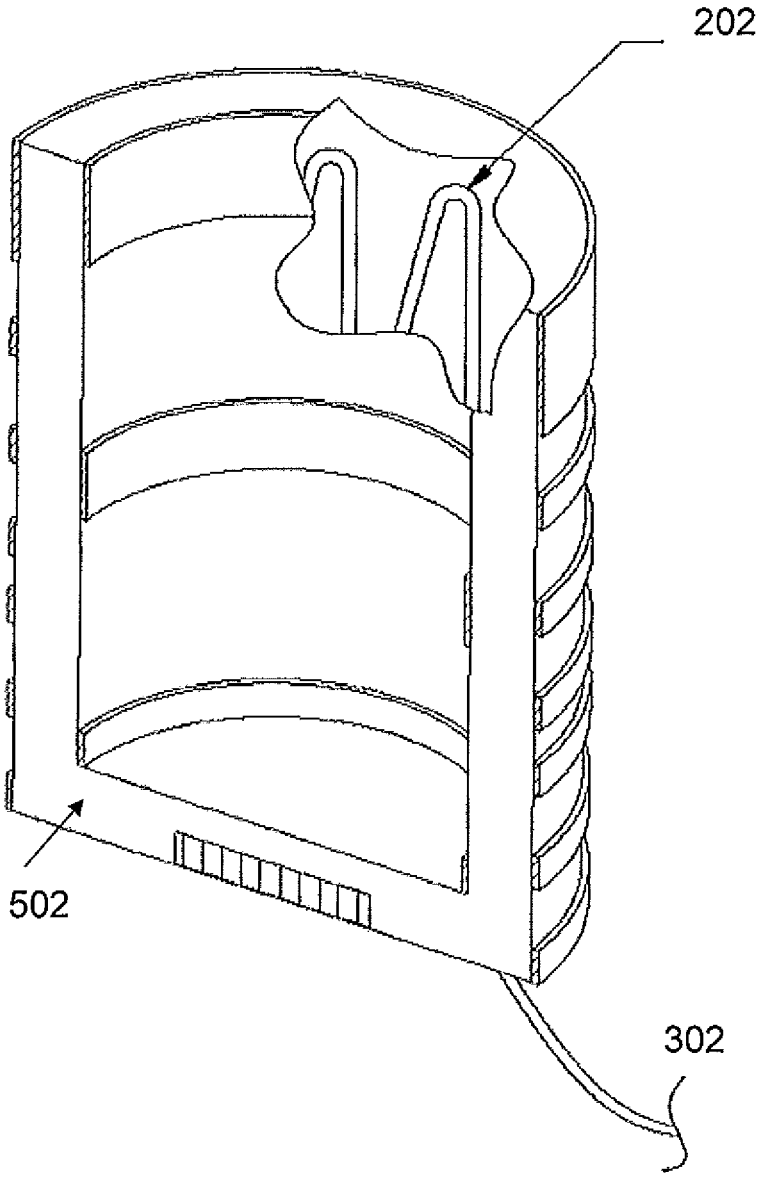
FIG. 7 depicts a cross-sectional view of a bottle warming apparatus featuring a partially removable bottom portion and electrical heating wires.
Figure 8:
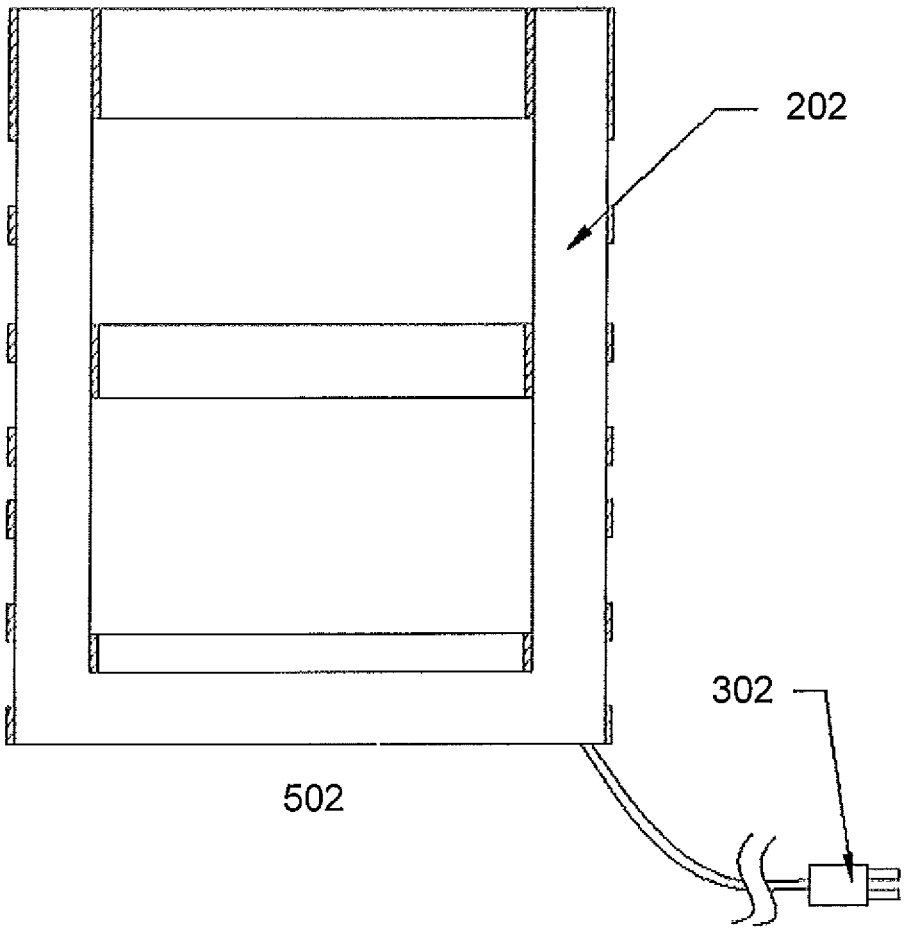
FIG. 8 depicts a front cross-sectional view of a bottle warming apparatus featuring a partially removable bottom portion featuring a wall charger.

Referring now also to FIG. 6, another bottle warmer 600 may be provided. Much like bottle warmer 200, the bottle warmer 600 may be fitted with electric heating wires or coils 202. Similarly, the heating wires or coils 202 may be shielded from the outer wall 108 and the inner wall 106 by various protective means. The bottle warmer 600 may include a mobile AC adapter 204, which may be utilized to charge the wires or coils 202 while the user is in a vehicle. Bottle warmer 600, however, may also include the removable or partially removable bottom portion 502. When a user removes or partially removes the bottom portion 502, the user may then remove the wires or coils 202 from the bottle warmer 600 if so desired. The wires or coils 202 may then be reinserted into the bottle warmer 600 when needed and the bottom portion 502 may be reattached. In another embodiment and referring additionally to FIGS. 7 and 8, another bottle warmer 700 may be provided. Bottle warmer 700 may be much like bottle warmer 600 in that it may include a removable or partially removable bottom portion 502, however, bottle warmer 700 may be fitted with an electrical adaptor 302 that may be plugged in to a house or wall unit instead of a vehicle.

Figure 9:
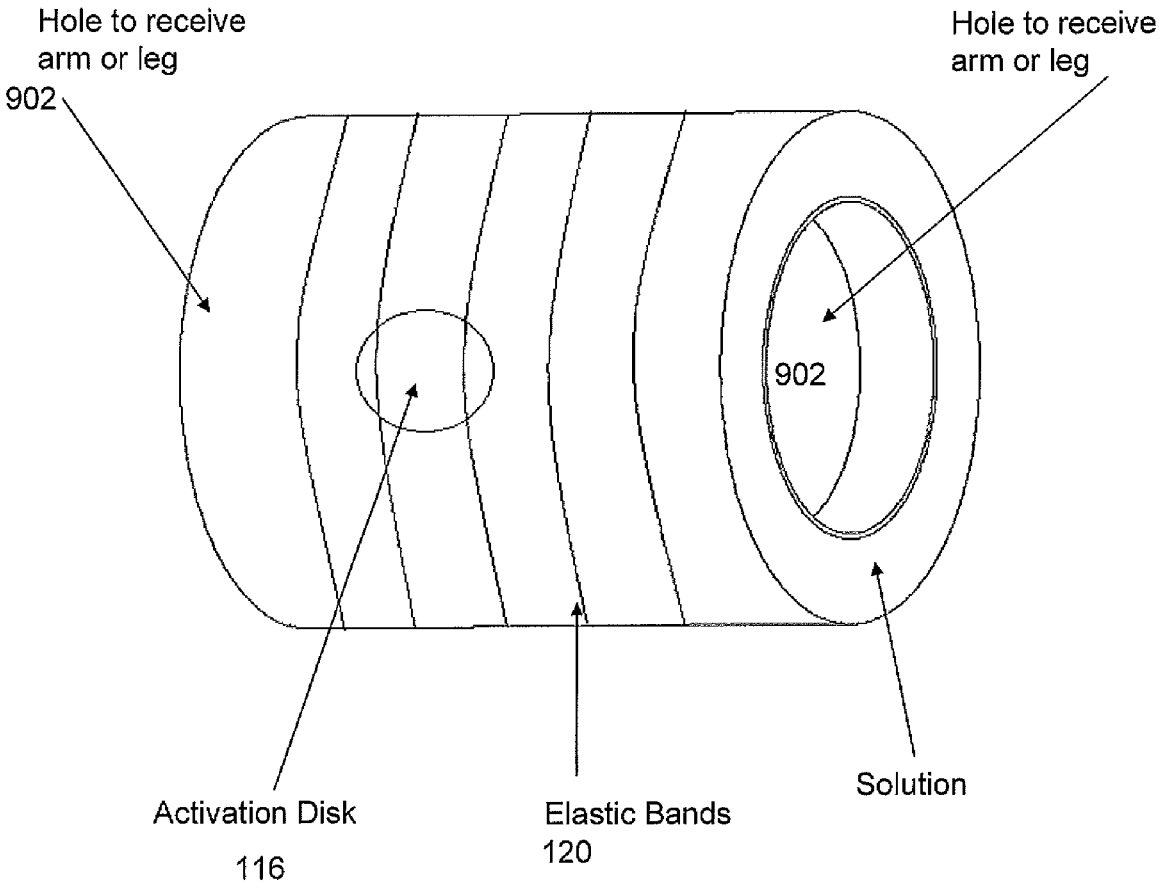
FIG. 9 depicts a bottle warming apparatus configured to fit on a user's arm or leg according to one embodiment.

Referring now also to FIG. 9, still another bottle warmer 900 may be provided. Instead of having a permanently closed or partially detachable bottom portion 502, bottle warmer 900 may be configured to be have a completely or partially open bottom portion 902 and top portion. In other words, the bottle warmer 900 may allow a user to stick their hand, leg, arm, or other objects completely through the bottle warmer 900. Thus, the bottle warmer 900 may be configured to provide warmth to the user, in addition to being utilized to warm bottles or other objects. Much like the various embodiments described above, the bottle warmer 900 may include elastic bands 120 which may allow the bottle warmer 900 to be held tight to the portion of the user's body that is in the bottle warmer 900. In an embodiment, the bottle warmer 900 may include adjustment mechanisms, such as straps, so that users of various sizes may utilize the bottle warmer 900.

In one embodiment, the various bottle warmers described herein may be configured to include a temperature gauge or thermometer for measuring the temperature of the bottle warmer. The temperature gauge or thermometer may be utilized to ensure that the temperature of the contents of the baby bottle 111 are not too hot or too cold. Temperature measurements recorded by the temperature gauge may be processed by utilizing an electronic processor. The electronic processor may then forward the measurements to a storage device for storage. The storage device, for example, may be a universal serial bus device that may be plugged into a computer or other computing device. Once plugged into a computer, the storage device may transfer recorded temperature measurements to the computer. In an embodiment, the bottle warmer may include a wireless transmitter/receiver, which may wireless transmit temperature measurements to a computer as well. In an embodiment, the processor may display the temperature measurements on a screen of the bottle warmer, cause a light to be displayed when a particular temperature is reached, output a sound when a particular temperature is reached, output a warning signal when the measured temperature is outside a threshold range, and/or display images.

In still another embodiment, a user may utilize a computer to send a signal to the bottle warmer to adjust the temperature down or up based on the temperature readings recorded by the temperature gauge or otherwise. Similarly, the bottle warmer may be fitted with buttons to increase or decrease the temperature as well. In another embodiment, the bottle warmer may include a timer, which may cause the bottle warmer to deactivate or power down after a set period of time. In another embodiment, the bottle warmer may include various types of ornaments which may decorate the outside wall of the bottle warmer. In yet another embodiment, the bottle warmer may include video games or other types of games that a user can play with when the user is not consuming food from the baby bottle 111.

Notably, features of the bottle warmers/warming apparatuses described herein can be combined or otherwise associated with the other apparatuses described above and/or the methods described below.

Figure 10:
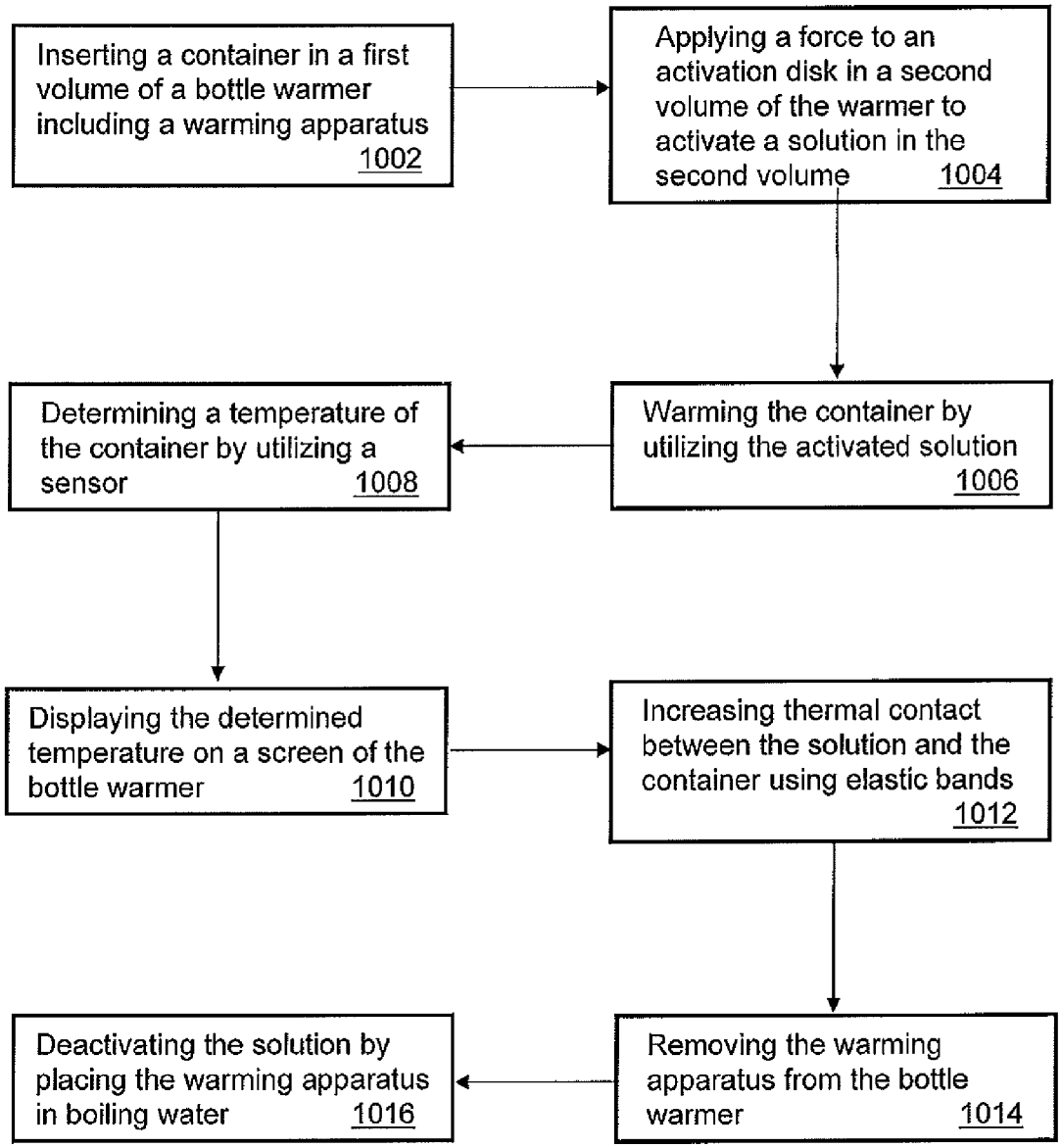
FIG. 10 illustrates an exemplary embodiment of a method for warming a bottle using a bottle warming apparatus.

Referring now to FIG. 10, an illustrative method 1000 for warming a container using a warming apparatus is schematically illustrated. Notably, the method 1000 is not intended to be limited to the apparatuses and components described above or illustrated in the drawings. The method 1000 can begin with step 1002, which may include inserting a container in a first volume of a bottle warmer including a warming apparatus. The first volume of the bottle warmer may be configured to receive various types of containers that are to be warmed and a second volume of the bottle warmer may be utilized to hold the warming apparatus in place in the bottle warmer. The warming apparatus may be a flexible container and may include a solution (such as the sodium acetate solution described above) and an activation disk for activating the solution. As noted above, the solution may include sodium acetate solution. The container may include various types of containers such as, but not limited to, plastic or glass bottles, baby bottles, and other similar containers.

Once the container is inserted into the bottle warmer or even prior to inserting the container into the bottle warmer, the method 1000 may include applying a force to the activation disk to cause the solution to undergo a chemical reaction to generate heat for the bottle warmer at step 1004. As the solution is undergoing the chemical reaction and thereby generating heat, the method 1000 may include warming the container in the bottle warmer by utilizing the generated heat at step 1006. In addition to including the warming apparatus, the bottle warmer may also include one or more sensors and processors for sensing, monitoring, and processing the temperature of the bottle warmer and/or container. At step 1008, the method 1000 may include determining a temperature of the container. Once the temperature of the container is determined, the method 1000 may include displaying the determined temperature on a screen of the bottle warmer at step 1010. In an embodiment, the temperature measurements may be uploaded through either wired or wireless means into a computing device.

A user of the bottle warmer may view the temperature on the screen of the bottle warmer to determine if the temperature needs to be adjusted. At step 1012, the method 1000 may include increasing thermal contact between solution in the warming apparatus and the container. The thermal contact may be increased by utilizing one or more elastic bands, which may be utilized to reduce air gaps between the warming apparatus and the container. Elastic bands may be added or removed by the user depending on whether or not the user wants to increase or decrease the thermal contact of the solution with the container. When the warming apparatus of the bottle warmer is no longer needed to warm the container, the method 1000 may include removing the warming apparatus from the bottle warmer at step 1014. The warming apparatus may be removed from the bottle warmer by detaching or partially detaching a portion of the bottle warmer. At step 1016, the method 1000 may include deactivating the solution by placing the removed warming apparatus in boiling water for a period of time sufficient for deactivation.

In an embodiment, the method 1000 may include not removing the warming apparatus from the bottle warmer. Instead, the warming apparatus may be left in the bottle warmer, and the entire bottle warmer may be placed in boiling water for a period of time to deactivate the solution. Once deactivated, the solution may then be reactivated again by applying force to the activation disk. The process may be repeated as necessary to keep various containers warm. Notably, the method 1000 may incorporate any of the functionality or features described for the various bottle warmers and warming apparatus described above and is not intended to be limited to the description above.

Upon reviewing the aforementioned embodiments, it would be evident to an artisan with ordinary skill in the art that said embodiments can be modified, reduced, or enhanced without departing from the scope and spirit of the claims described below.

At least a portion of the methodologies and techniques described with respect to the exemplary embodiments can incorporate a machine or other computing device within which a set of instructions, when executed, may cause the machine to perform any one or more of the methodologies or functions discussed above. In some embodiments, the machine operates as a standalone device. In some embodiments, the machine may be connected (e.g., using a network) to other machines. In a networked deployment, the machine may operate in the capacity of a server or a client user machine in server-client user network environment, or as a peer machine in a peer-to-peer (or distributed) network environment. The machine may comprise a server computer, a client user computer, a personal computer (PC), a tablet PC, a laptop computer, a desktop computer, a control system, a network router, switch or bridge, or any machine capable of executing a set of instructions (sequential or otherwise) that specify actions to be taken by that machine. Further, while a single machine is illustrated, the term "machine" shall also be taken to include any collection of machines that individually or jointly execute a set (or multiple sets) of instructions to perform any one or more of the methodologies discussed herein.

The machine may include a processor (e.g., a central processing unit (CPU), a graphics processing unit (GPU, or both), a main memory and a static memory, which communicate with each other via a bus. The machine may further include a video display unit (e.g., a liquid crystal display (LCD), a flat panel, a solid state display, or a cathode ray tube (CRT)). The machine may include an input device (e.g., a keyboard), a cursor control device (e.g., a mouse), a disk drive unit, a signal generation device (e.g., a speaker or remote control) and a network interface device.

The disk drive unit may include a machine-readable medium on which is stored one or more sets of instructions (e.g., software) embodying any one or more of the methodologies or functions described herein, including those methods illustrated above. The instructions may also reside, completely or at least partially, within the main memory, the static memory, and/or within the processor during execution thereof by the machine. The main memory and the processor also may constitute machine-readable media.

Dedicated hardware implementations including, but not limited to, application specific integrated circuits, programmable logic arrays and other hardware devices can likewise be constructed to implement the methods described herein. Applications that may include the apparatus and systems of various embodiments broadly include a variety of electronic and computer systems. Some embodiments implement functions in two or more specific interconnected hardware modules or devices with related control and data signals communicated between and through the modules, or as portions of an application-specific integrated circuit. Thus, the example system is applicable to software, firmware, and hardware implementations.

In accordance with various embodiments of the present disclosure, the methods described herein are intended for operation as software programs running on a computer processor. Furthermore, software implementations can include, but not limited to, distributed processing or component/object distributed processing, parallel processing, or virtual machine processing can also be constructed to implement the methods described herein.

The present disclosure contemplates a machine readable medium containing instructions, or that which receives and executes instructions from a propagated signal so that a device connected to a network environment can send or receive voice, video or data, and to communicate over the network using the instructions. The instructions may further be transmitted or received over a network via the network interface device.

While the machine-readable medium is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding or carrying a set of instructions for execution by the machine and that cause the machine to perform any one or more of the methodologies of the present disclosure.

The term "machine-readable medium" shall accordingly be taken to include, but not be limited to: solid-state memories such as a memory card or other package that houses one or more read-only (non-volatile) memories, random access memories, or other re-writable (volatile) memories; magneto-optical or optical medium such as a disk or tape; or other self-contained information archive or set of archives is considered a distribution medium equivalent to a tangible storage medium, Accordingly, the disclosure is considered to include any one or more of a machine-readable medium or a distribution medium, as listed herein and including art-recognized equivalents and successor media, in which the software implementations herein are stored.

The illustrations of arrangements described herein are intended to provide a general understanding of the structure of various embodiments, and they are not intended to serve as a complete description of all the elements and features of apparatus and systems that might make use of the structures described herein. Many other arrangements will be apparent to those of skill in the art upon reviewing the above description. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Thus, although specific arrangements have been illustrated and described herein, it should be appreciated that any arrangement calculated to achieve the same purpose may be substituted for the specific arrangement shown. This disclosure is intended to cover any and all adaptations or variations of various embodiments and arrangements of the invention. Combinations of the above arrangements, and other arrangements not specifically described herein, will be apparent to those of skill in the art upon reviewing the above description. Therefore, it is intended that the disclosure not be limited to the particular arrangement(s) disclosed as the best mode contemplated for carrying out this invention, but that the invention will include all embodiments and arrangements falling within the scope of the appended claims.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims.

What is claimed is:

1. An apparatus for warming a container, the apparatus comprising:

a holder having an inner wall, an outer wall, and an insulation layer between the inner and outer walls, wherein the inner wall defines a first volume having a size and shape for receiving at least a portion of the container, and wherein the holder defines a second volume;

a solution positioned within the second volume;

an activation disk positioned within the second volume and in contact with the solution, wherein the solution and activation disk are made from materials such that a force applied to the activation disk causes the solution to undergo a chemical reaction that generates heat for warming the container in the first volume;

a disk actuator for applying the force to the activation disk;

a first elastic band in the first volume that is adapted to increase thermal contact between the container, the inner wall, and the solution;

a second elastic band in the second volume that is adapted to increase thermal contact between the container and the solution in conjunction with the first elastic band.

2. The apparatus of claim 1, wherein the inner wall is flexible and has an annular shape.

3. The apparatus of claim 1, further comprising a flexible container positioned in the second volume, wherein the solution and the activation disk are positioned in the flexible container.

4. The apparatus of claim 1, further comprising a temperature gauge for measuring a temperature associated with the container.

5. The apparatus of claim 1, wherein the second volume is concentrically aligned with the first volume.

6. The apparatus of claim 1, wherein the insulation layer has an annular shape and further comprising another elastic band that circumscribes the insulation layer.

7. The apparatus of claim 1, wherein the solution comprises sodium acetate and wherein the chemical reaction comprises crystallization of the solution.

8. The apparatus of claim 7, wherein the activation disk comprises at least one of stainless steel, Berylium-copper alloy and phosphor-bronze alloy.

9. The apparatus of claim 3, wherein the flexible container is removable from the second volume.

10. A method for warming a container using an apparatus, the method comprising:

inserting a container in a holder that defines first and second volumes, wherein the holder includes a removable bottom portion, wherein the apparatus includes a fastening mechanism for attaching the removable bottom portion to the holder, wherein the apparatus includes an insulation portion surrounding the first and second volumes, wherein the apparatus includes a conductive material in between the first and second volumes, wherein the first volume has a size and shape for receiving at least a portion of the container, wherein the second volume is concentrically aligned with the first volume, and wherein an activation disk and a solution are contained in the second volume;

applying a force to the activation disk to cause the solution to undergo a chemical reaction that generates heat for warming the container in the first volume; and increasing the thermal contact between the solution and the container using one or more elastic bands in the second volume.

11. The method of claim 10, further comprising sensing a temperature of the container and displaying the temperature on a display device operably connected to the holder.

12. The method of claim 10, further comprising positioning a removable flexible container in the second volume, wherein the removable flexible container comprises the activation disk and the solution.

13. The method of claim 12, wherein the solution comprises sodium acetate and wherein the chemical reaction comprises crystallization of the solution.

14. An apparatus for warming a container, the apparatus comprising:

a holder defining first and second volumes and including a removable bottom portion, wherein the second volume is concentrically aligned with the first volume, and wherein the first volume has a size and shape to receive at least a portion of the container;

a fastening mechanism for attaching the removable bottom portion to the holder;

an insulation portion surrounding the first and second volumes;

one or more elastic bands; and a conductive material in between the first and second volumes, wherein a solution is positionable in the second volume, wherein an activation disk is positionable within the second volume to be in contact with the solution, wherein the activation disk and the solution are made from materials whereby application of a force to the activation disk causes the solution to undergo a chemical reaction and thereby generate heat, and wherein the elastic band increases the thermal contact between the solution and the container.

15. The apparatus of claim 14, wherein a first portion of the removable bottom portion is permanently attached to the holder and wherein a second portion of the removable bottom portion is removable by utilizing the fastening mechanism.

16. The apparatus of claim 15, wherein the fastening mechanism comprises at least one of a zipper mechanism, a button mechanism, a hook and eye mechanism, a glue mechanism, and a clip mechanism.

17. The apparatus of claim 15, further comprising a flexible container positioned in the second volume that is removable therefrom, wherein the solution and the activation disk are positionable in the flexible container, and wherein the elastic band is in proximity to and circumscribes the flexible container.

18. The apparatus of claim 15, the apparatus comprising an electronic processor, wherein the processor is adapted to perform at least one of display a monitored temperature associated with the warming apparatus, display a light, output a sound, output a warning when the monitored temperature is outside a threshold range, and display an image.

19. The apparatus of claim 15, further comprising a disk actuator for applying the force to the activation disk.

20. The apparatus of claim 15, wherein the solution comprises sodium acetate and wherein the chemical reaction comprises crystallization of the solution.

21. An apparatus for warming, the apparatus comprising:

a holder defining first and second volumes, the first volume having a size and shape for receiving at least a portion of an object via at least one of a top and a bottom portion of the holder, wherein the top and bottom portions are at least partially open;

a solution positioned within the second volume;

an activation disk positioned within the second volume and in contact with the solution, wherein the solution and activation disk are made from materials such that a force applied to the activation disk causes the solution to undergo a chemical reaction that generates heat for warming the object in the first volume;

a disk actuator for applying the force to the activation disk;

a first elastic band in the first volume that is adapted to increase thermal contact between the object and the solution;

a second elastic band in the second volume that is adapted to increase thermal contact between the object and the solution in conjunction with the first elastic band.

* * * * *